US006533050B2

(12) United States Patent
Molloy

(10) Patent No.: US 6,533,050 B2
(45) **Date of Patent: *Mar. 18, 2003**

(54) EXCAVATION BIT FOR A DRILLING APPARATUS

(76) Inventor: Anthony Molloy, 241 Attunga Rd., Yowie Bay, New South Wales (AU), 2228

( * ) Notice: Subject to any disclaimer, the term of this patent is extended or adjusted under 35 U.S.C. 154(b) by 0 days.

This patent is subject to a terminal disclaimer.

(21) Appl. No.: 09/829,006

(22) Filed: Apr. 10, 2001

(65) Prior Publication Data

US 2001/0045304 A1 Nov. 29, 2001

Related U.S. Application Data

(63) Continuation-in-part of application No. 09/125,856, filed as application No. PCT/AU97/00111 on Feb. 26, 1997, now Pat. No. 6,230,826.

(30) Foreign Application Priority Data

Feb. 27, 1996 (AU) ..... 8324

(51) Int. Cl.[7] ..... E21B 10/08
(52) U.S. Cl. ..... 175/351; 175/373
(58) Field of Search ..... 175/361, 91, 350, 175/351, 365, 373

(56) References Cited

U.S. PATENT DOCUMENTS

| | | | | |
|---|---|---|---|---|
| 1,660,309 | A | 2/1928 | Duda | 175/364 |
| 2,058,626 | A | 10/1936 | Reed | 175/350 |
| 2,215,264 | A | 9/1940 | Fisher | 384/92 |

(List continued on next page.)

FOREIGN PATENT DOCUMENTS

| | | |
|---|---|---|
| AU | 58500/86 | 3/1990 |
| DE | 2839868 | 4/1979 |
| DE | 19521447 | 12/1996 |
| EP | 159801 | 10/1985 |
| GB | 2203774 | 10/1988 |

OTHER PUBLICATIONS

Derwent Abstract Accession No. J305E/29, SU 866 202 (Odinets SI) Sep. 25, 1981.
Derwent Abstract Accession No. M8990E/39 , SU 885 535 (Mosc Geology Survey) Nov. 30, 1981.

(List continued on next page.)

*Primary Examiner*—David Bagnell
*Assistant Examiner*—Jennifer R. Dougherty
(74) *Attorney, Agent, or Firm*—Cahn & Samuels, LLP

(57) ABSTRACT

The invention provides an excavation bit, which is constructed from either a single or double carrier. If two carriers are present the carriers are contra-rotating. By the off setting of the axes of rotation of single or dual carriers from a longitudinal axis of the bit, and by driving to carriers to rotate, a ground engaging thrust is produced, as well as the rotation of the excavation bit in the ground as a consequence of the rotation of the carriers, and not vice versa as is the case with prior art. By the invention, there can result sufficient thrust on the bit, by the rotation of the carriers, so that the need to apply thrust down the bore via the drill rod is reduced or eliminated. As a result of the invention the number and or size of the ground engaging tools are not a function of the bore diameter to be drilled. Thus as the excavation bit is scaled up for larger diameter bores more ground engaging tools and or an increase in their size is not required. By the invention, thrust applied (either via the drill rod or from the rotation of the carriers) is thought to be, through a quasi lever system, multiplied at some of the ground engaging tools in the radial direction. That is the total thrust in the longitudinal axis direction (whether externally applied or resultant from the contra-rotation of the carriers), is multiplied so that the outward forces exerted (by the cutters onto the rock surface in the region approaching perpendicular to the longitudinal axis of the bore) is thought to be significantly higher than the magnitude of the total thrust.

23 Claims, 18 Drawing Sheets

U.S. PATENT DOCUMENTS

| | | | | |
|---|---|---|---|---|
| 2,704,204 | A | 3/1955 | Koontz | 175/370 |
| 2,725,215 | A | 11/1955 | Macneir | 175/298 |
| 4,549,614 | A | 10/1985 | Kaalstad et al. | 175/339 |
| 4,706,765 | A | 11/1987 | Lee et al. | 175/334 |
| 4,790,397 | A | 12/1988 | Kaalstad et al. | 175/365 |
| 4,796,713 | A | 1/1989 | Bechem et al. | 175/96 |
| 4,832,143 | A | 5/1989 | Kaalstad et al. | 175/365 |
| 5,064,007 | A | 11/1991 | Kaalstad | 175/334 |
| 5,439,068 | A | 8/1995 | Huffstutler et al. | 175/356 |
| 5,626,201 | A | 5/1997 | Friant et al. | 175/365 |

OTHER PUBLICATIONS

Derwent Abstract Accession No. 84–27431/44 ,SU 994 675 (Novch Poly (Hard×)) Feb. 17, 1983.

Derwent Abstract Accession No. 84–170333/27, SU 1 051 029 (Skochinski Mining Inst.) Oct. 30, 1983.

Derwent Abstract Accession No. 91–191199/26, SU 1583 582 (N Caucausis Oil Ini.) Aug. 7, 1990.

RU2023852 (Drilling Tech. Res. Inst.) Nov. 30, 1994.

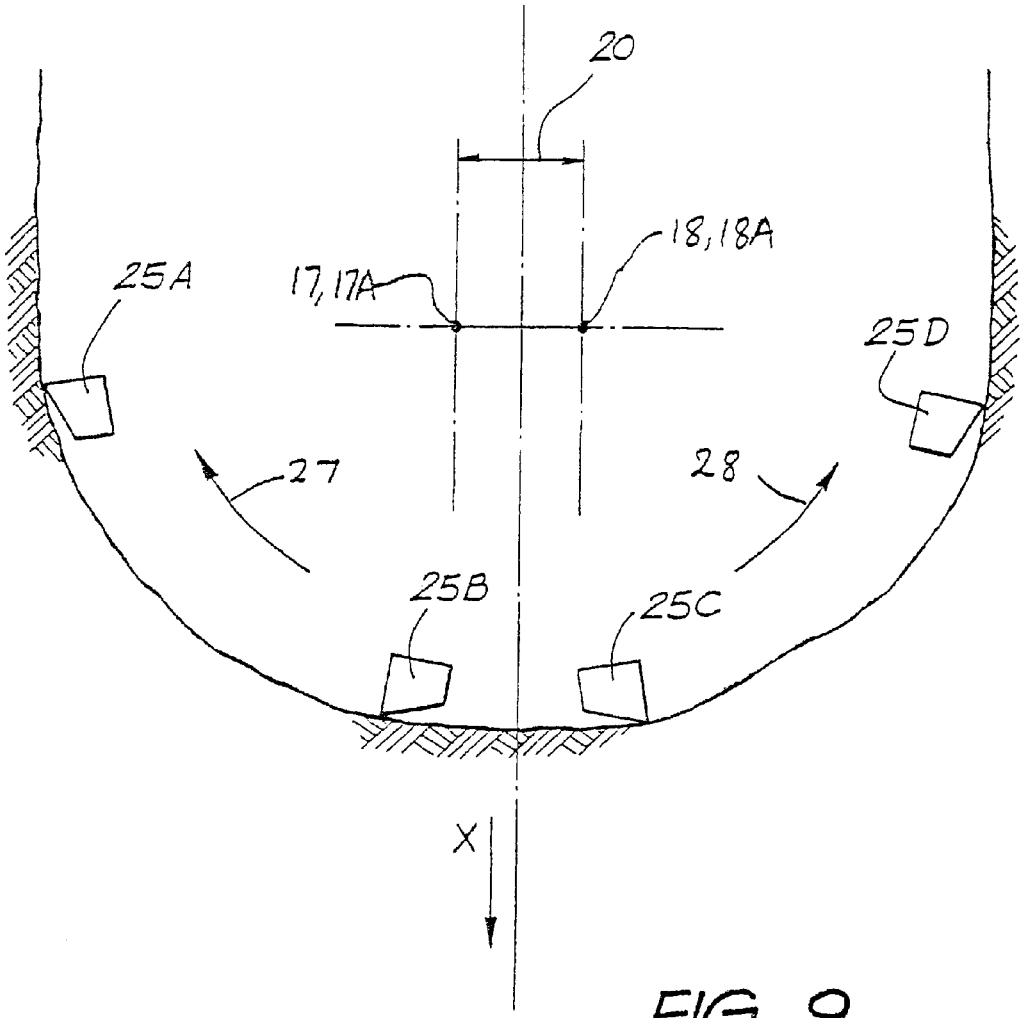
FIG. 9
FIG 18
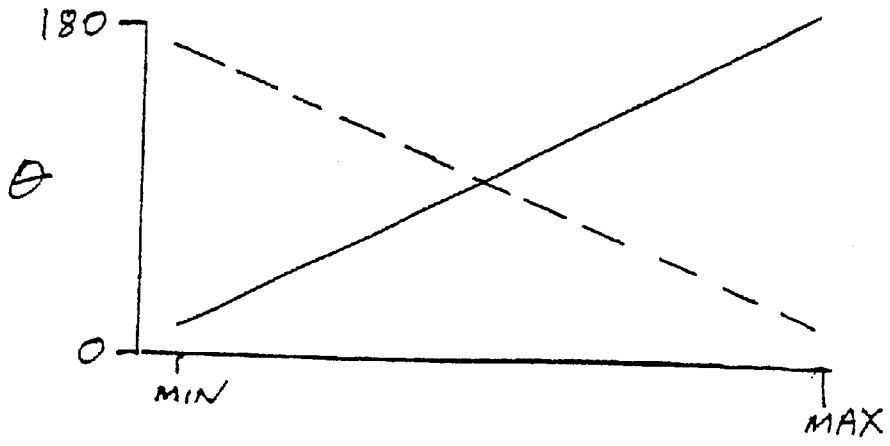

EXCAVATION BIT FOR A DRILLING APPARATUS

This application is a continuation-in-part of U.S. patent application Ser. No. 09/125,856, filed Aug. 26, 1998, U.S. Pat. No. 6,230,826 which is hereby incorporated by reference.

I. FIELD OF THE INVENTION

The present invention relates to an excavation bit which is used to bore rock or earth surfaces.

II. BACKGROUND OF THE INVENTION

The prior art drilling apparatus use an excavation bit for conventional (near surface to far surface) drilling, or a reverse reaming bit for far surface to near surface drilling, comprising one or more ground engaging formations mounted on the excavation bit. The ground engaging formations can be either drag, button, tooth, disc, point attack or other cutters on the bit to excavate rock. The main disadvantages with these types of bits is that to produce a larger hole will require more cutters, and as such a greater torque and thrust must be applied to the bit. Thus an operator is limited in the size of bores that can be excavated by the amount of power available from the driving equipment. The operation of conventional bits is performed by the revolving of the body of the bit, which then causes the cutters and carrier to rotate because the cutters are in contact with the earth surface. This action then allows the cutters on the bit to excavate the earth beneath the bit. The crushing and/or cutting thrust onto the surface being excavated must be totally supplied to the drill bit from a rotational unit which also produces thrust. Additional thrust is supplied by the weight of the bit which is an advantage in some excavations and a disadvantage in others.

III. SUMMARY OF THE INVENTION

The invention provides an excavation bit including a main body having a longitudinal axis which is coaxial with a longitudinal axis of a drill rod when connected to said bit, and first and second transverse axes, said axes being substantially orthogonal to each other; a carrier rotatably connected to said main body and having excavation means positioned about its periphery, said carrier having its axis of rotation generally in the direction of said first transverse axis and offset along said second transverse axis from said longitudinal axis of said main body, the axis of rotation of said carrier also being angularly offset from said first transverse axis, said excavation means having their centre of rotation offset along said axis of rotation from said longitudinal axis and or said second transverse axis; a reaction member mounted to the main body to engage the wall of a bore formed by said excavation bit; bearing means and seal means between said carrier and said main body; driving means to directly rotate said carrier about its axis of rotation, said rotation of said carrier producing rotation of said bit about said longitudinal axis.

The invention provides an excavation bit including a main body having a longitudinal axis and first and second transverse axes, said axes being substantially orthogonal to each other; at least two carriers rotatably connected to the main body having excavation means positioned about their respective peripheries, said carriers having their axes of rotation offset along said second transverse axis in opposite directions from said longitudinal axis, said axes of rotation generally extending away from said main body so as to position said carriers on opposite sides of said main body, said carrier further including each axis of rotation of receptive carriers is angularly offset from said first transverse axis, said excavation means having their respective centres of rotation offset along said axis of rotation from said longitudinal axis and or said second transverse axis; bearing means and seal means between said carriers and said body; driving means to directly contra-rotate said carriers, said rotation of said carriers producing rotation of said bit about said longitudinal axes when said excavation means engage earth to be excavated.

Preferably each axis of rotation remains in a plane through both the first transverse axis and the axis of rotation, which is substantially parallel to a plane containing the first transverse axis and the longitudinal axis.

Preferably when each carrier is viewed from the direction of the second transverse axis, the axes of rotation each lie at an angle to the longitudinal axis and the carriers angle towards each other.

Preferably the carrier or carriers are of an annular construction.

Preferably driving means includes a drive shaft which engages either directly or via an intermediate gear a gear on each carrier, to thereby rotate the carrier.

Preferably the carrier or carriers are driven by means of a single motor to drive one or two carriers or two motors to drive two carriers with the motor or motors being mounted within the main body.

Preferably the angle between the axes of rotation is in the range of less than but not equal to 180° and greater than but not equal to 0°, such that a level of thrust in an excavation direction and a magnitude of force to cause rotation of the bit around the longitudinal axis, which will be appropriate for a type of material to be excavated.

Preferably the axis of rotation of each carrier is at an angle of between greater than but not equal to 0° and less than but not equal to 90° to the longitudinal axis, so as to produce a level of thrust in an excavation direction and a magnitude of force to cause rotation of the bit around the longitudinal axis, which will be appropriate for a type of material to be excavated.

Preferably the carrier or carriers approach but never cross the longitudinal axis.

Preferably the excavation means includes one of the following: pick; drag; roller button; roller tooth; disc roller cutter; blade; knife.

Preferably each carrier has as many excavation means mounted thereon to ensure that at any one time at least one excavation means of each carrier is in engagement with earth to be excavated.

Preferably the bit also includes a pilot bit rotatably mounted thereon.

Preferably excavating means are located on surfaces of each carrier adjacent or next adjacent the maximum perpendicular distance from the axis of rotation.

Preferably the excavation bit is constructed as a reamer and is adapted to be pulled through earth as excavation occurs.

Preferably affixed or rotatably attached to the main body is a stabiliser to assist the excavation bit keeping to a desired path.

Preferably the reaction member is a roller means to engage a bore surface.

Preferably the excavation bit also includes means to assist in the removal of debris from the bore or to lubricate the excavation bit in the bore.

Preferably the axis of rotation of the carrier, when there is only one carrier, is angularly offset from the first transverse axis, so that when the carrier is viewed from the direction of the second transverse axis, the axis of rotation each lies at an angle to the longitudinal axis.

IV. BRIEF DESCRIPTION OF THE DRAWINGS

Embodiments of the invention will now be described, by way of example only, with reference to the accompanying drawings.

FIG. 9 is a schematic of a side elevation illustrating the movement of the cutting teeth.

FIG. 18 is a schematic graph of the expected simplified relationship between angle, thrust and rotation.

V. DETAILED DESCRIPTION OF THE EMBODIMENTS

Figure 1:
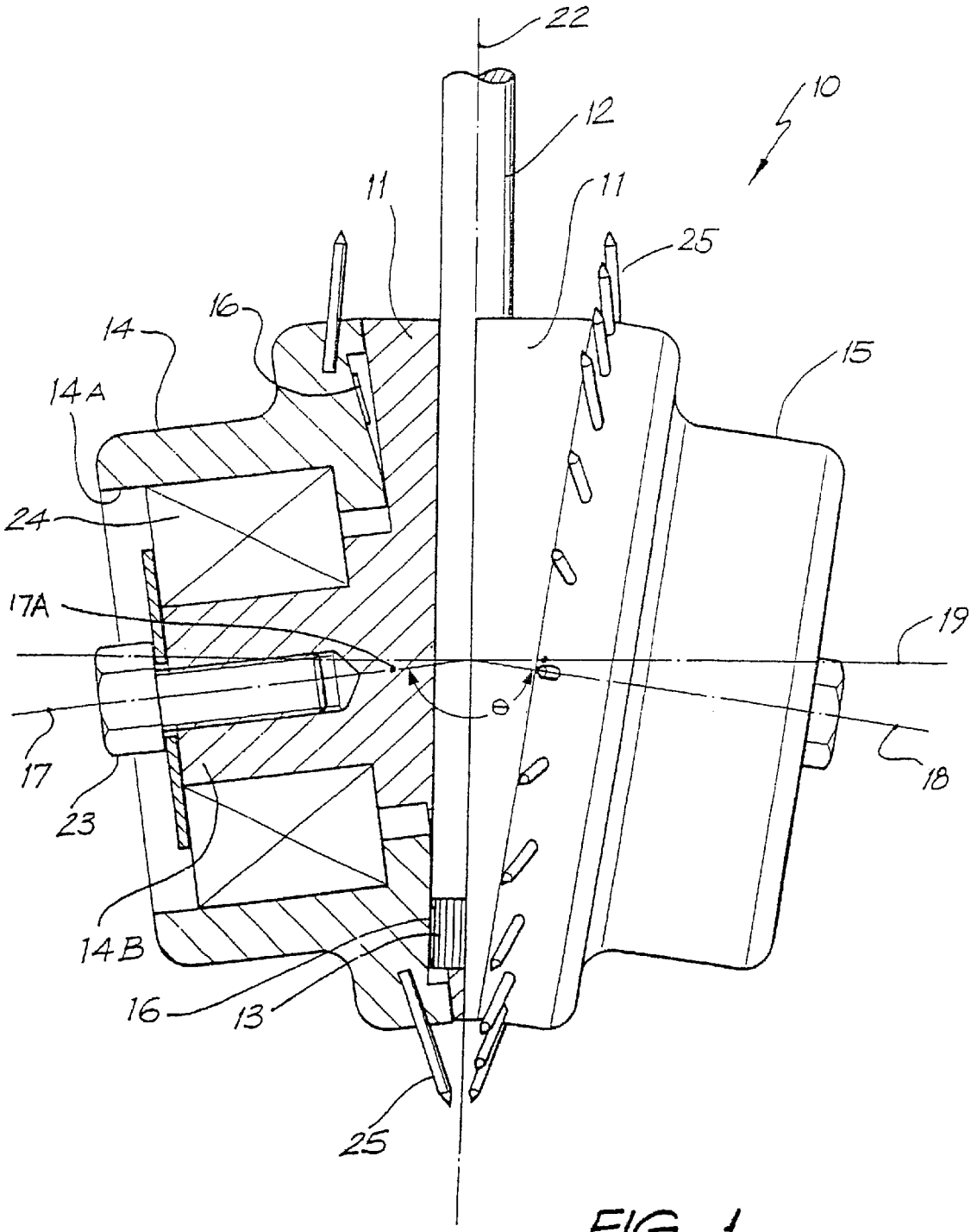
FIG. 1 is a diagrammatic front elevation and part cross section of an excavation bit showing the two cutter carriers.
Figure 2:
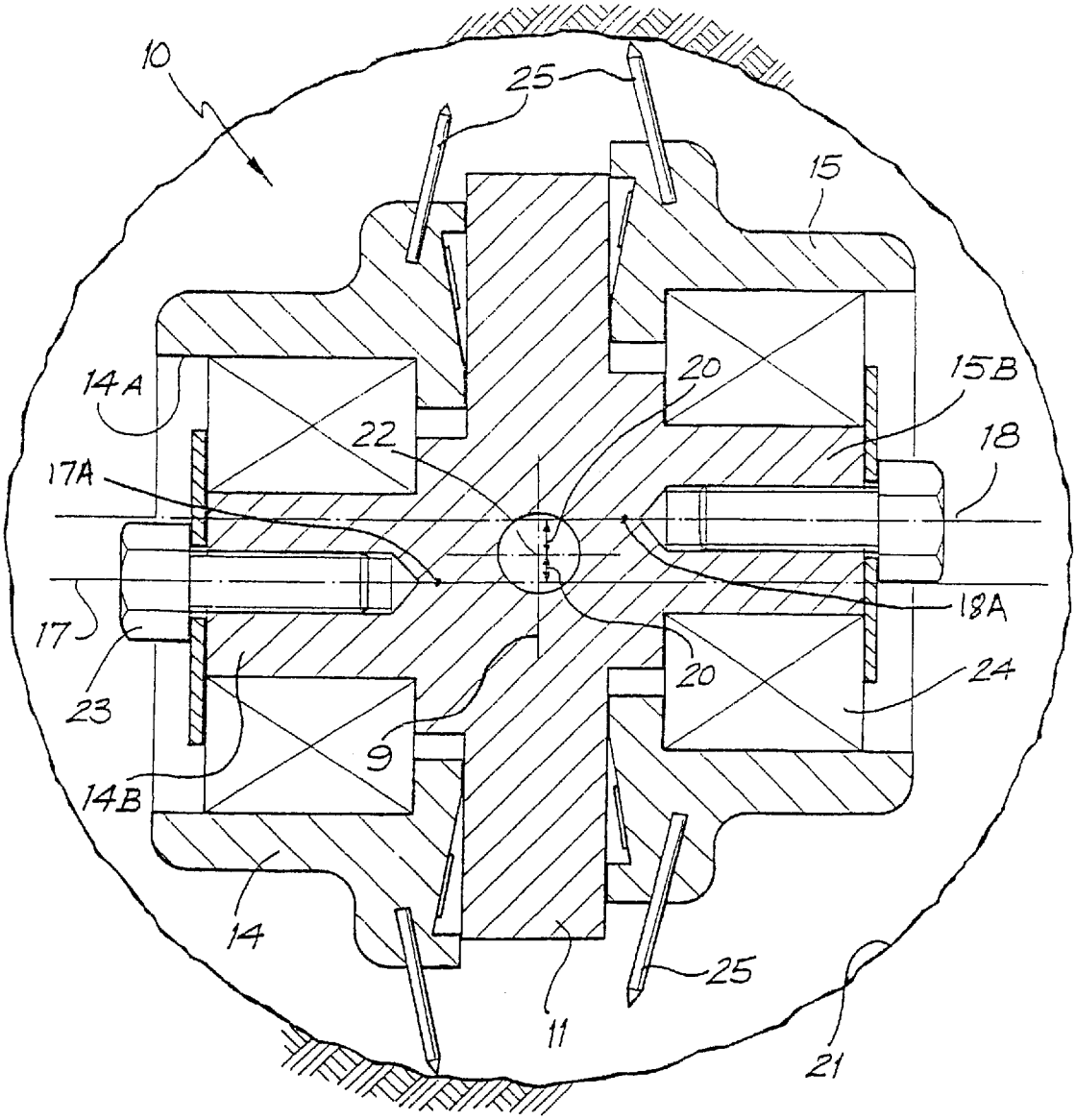
FIG. 2 is two half cross sections section through the axes of rotation of the bit carriers.

As illustrated in FIGS. 1 and 2, the excavation bit 10, includes a main body 11 and a drive shaft 12, which can be connected to a drill rod (not illustrated). Rotatably connected to main body 11 are two carriers 14 and 15 each having a series of equi-spaced cutters 25. The carriers 14 and 15 are annular and generally disc shaped and include a cylindrical bearing and seal housing 14A. The main body 11 includes stub axles 14B and 15B (the latter being shown in FIG. 2) which provide axes of rotation 17 and 18 respectively, for the carriers 14 and 15.

The carriers 14 and 15 are rotatably secured and located into place on the axles 14B and 15B respectively, by securing means 23, shown here as a bolt, but could also be retained by the ball bearing 24 itself or other means. Bearing 24 includes a seal means to seal one end of the carriers 14 and 15 relative to the main body 11. The carriers 14 and 15, have internal gears 16 inside of the periphery of the carriers 14 and 15. The gears 16 form a circular ring around carriers 14 and 15 and mesh with a geared end 13 of the drive shaft 12. By rotation of the geared end 13, the carriers are directly rotated by the rotation of the drive shaft 12. As will be described later, this direct rotation produces rotation of the bit 10 around the longitudinal axis 22. The term "direct" or "directly" refers to the fact that rotation of the carriers 14 and 15 is not produced by the rotation of the drive shaft causing the bit 10 to revolve, which in turn would cause the carrier to rotate because it is in contact with the ground.

The carriers 14 and 15 in FIG. 1 have their axes of rotation 17 and 18 respectively, angularly offset from a first transverse axis 19 by being inclined at an angle of some 15° to a first transverse axis 19. The centre of rotation 17A and 18A of the tips of the cutters 25 or the centre of mass of the cutters 25, is also offset from a second transverse axis 9 along the axes of rotation 17 and 18 and by virtue of an offset distance 20 (which will be described below) are also offset from the longitudinal axis 22. The angle between the axes of rotation 17 and 18 and the first transverse axis 19 could be selected between an angle greater than but not equal to 0° and less than but not equal to 90° (the directions being determined by the purpose of the bit eg. conventional or reaming operations) which will result in the angle θ varying from an angle less than but not equal to 180° to greater than but not equal to 0°.

As illustrated in FIG. 2, the carriers 14 and 15 also have their axes of rotation 17 and 18 respectively, offset from each other and from the longitudinal axis 22 (into the page of FIG. 2), by two offset distances 20, measured along a second transverse axis 9. The magnitude of the offset distances 20 is determined by the amount of clearance required between the earth being excavated and the cutters not required to be in contact. Another factor which will influence the magnitude of the offset distances 20 is the size of the bit to be manufactured. The directions of the offset of the carriers 14 and 15 is determined by the drill rod rotation and the carrier rotation as is mentioned later.

The carriers 14 and 15 each have a plurality of cutters 25, equi-spaced about a peripheral circumference of the carriers 14 and 15, shown in FIGS. 1 and 2 in the form of picks. However, the carriers 14 and 15 can be modified to accommodate either drag, roller button, roller tooth, disc roller cutters, blades, knives and any other form of attachable excavation means which is designed to engage and excavate earth surfaces. A minimum of one such cutter per carrier 14 and 15 is required to be in contact with the surface at any one time for operation of the bit 10. This may require a minimum of 4 or 5 cutters per carrier if the cutters 25 have the forms illustrated in the drawings.

The offsets distances 20 ensure that the bit 10 has at least a quarter of the carriers (if 4 or more) 14 and 15 engaged with a rock surface 21 (see also FIG. 3) at any time. This engagement provides the excavation action and also provides the rotation of the bit 10, about the longitudinal axis 22 (see FIG. 1) when the drive shaft 12 is rotated. The drive shaft 12 has its longitudinal axis coaxial or collinear with longitudinal axis 22.

Figure 4:
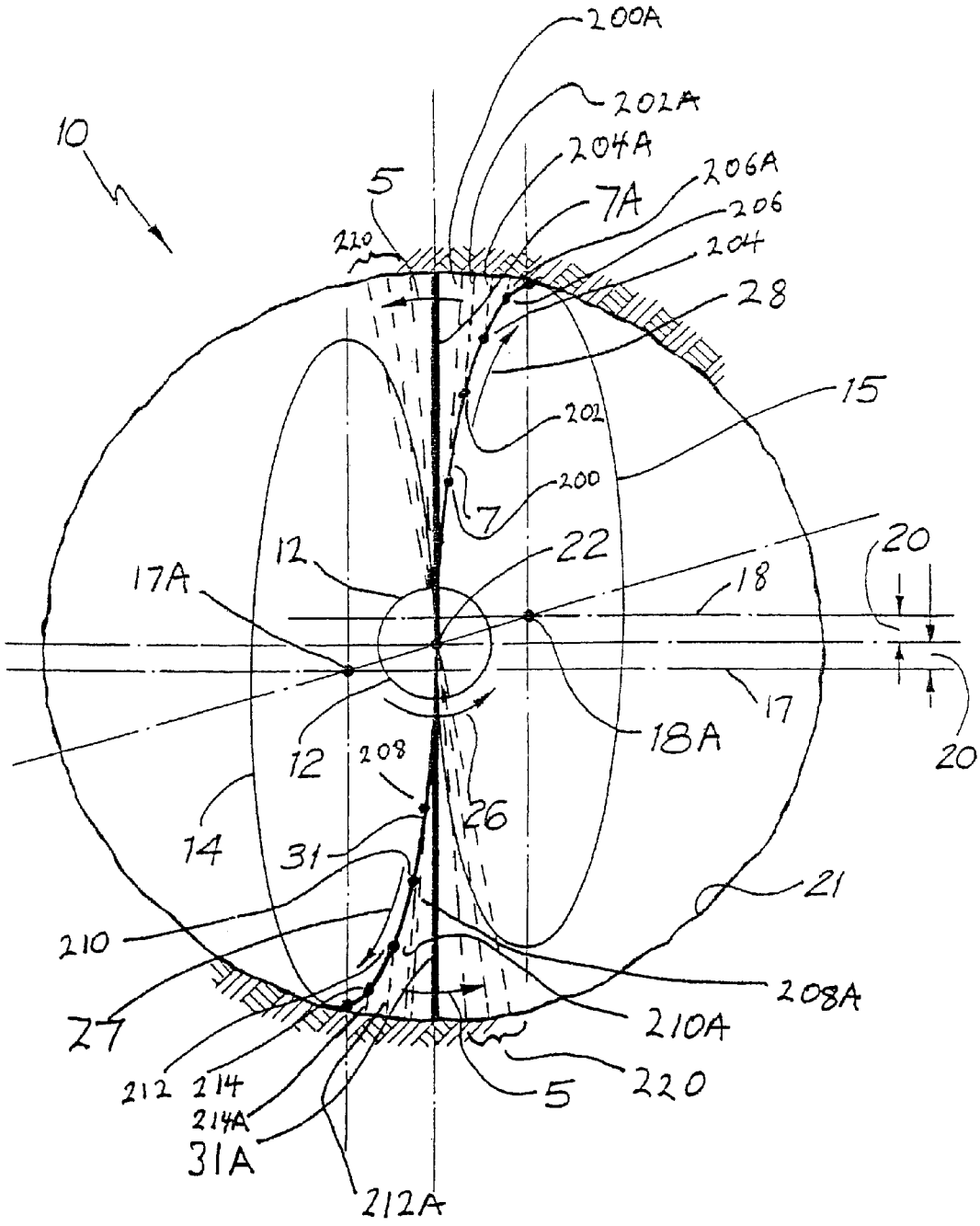
FIG. 4 is a schematic plan of the apparatus of FIG. 1, showing the line of contact of the circumference of the tips of the cutters with the rock surface.

In FIG. 4 it can be seen that rotation of the drive shaft 12 in the direction 26 results in the rotation of the bit 10 in the direction of arrows 5, and that the arrows 5 will have the same sense or direction as that of direction 26.

In FIG. 4, bold lines 31 and 7 respectively represent the possible points of contact or engagement of cutters 25 mounted on the respective carriers 14 and 15, at any time. Because of: the angle θ; the centres of rotation 17A and 18A are offset in two orthogonal directions from the longitudinal axis 22 along the directions of the axes of rotation 17 and 18, and along the second transverse axis 9; and the positional arrangement of the carriers 14 and 15 relative to main body 11, once the carriers 14 and 15 are driven by the rotation of the drive shaft 12 in the direction 26, the main body 11 will rotate in the direction of arrow 5, and cutters 25 on respective carriers 14 and 15, will begin their engagement with the ground near longitudinal axis 22. However, because of the revolving of the cutter 25 around the circumference of the respective carriers 14 and 15, which carriers are each at an angle θ/2 to the longitudinal axis 22, there results a substantially line engagement 31A and 7A respectively of those cutters, with the rock surface 21. This line may be straight in plan view as depicted in FIG. 4, if the angular speed of the cutter around the carrier in a plane perpendicular to the longitudinal axis 22 is equal to the angular speed of rotation of the main body 11 in the opposite direction, in the same plane.

The motion of the cutters 25 described in the above paragraph will now be further illustrated. In FIG. 4 the some cutters 25 have been reassigned item numbers 200, 202, 204, 206, and 208, 210, 212, 214 on carriers 15 and 14, respectively. This is done for the purpose of illustration of the path of individual cutters. The paths, with respect to the rock surface, of the cutters on carrier 15, are as follows: cutter 200 will have a radial (relative to longitudinal axis 22) straight line path 200A, 202 will have a radial straight line path 202A and so on for cutters 204 and 206 and respective paths 204A and 206A. The same will occur in respect of the cutters 208 to 214 and the respective paths 208A to 214A, on carrier 14. The paths of other cutters 25 which are located on the carriers 14 and 15, but which had not engaged the rock surface at the time of engagement of the cutters renumbered as cutters 200 to 214, will make radial straight line paths 220 as the main body 11 rotates in the direction of arrows 5.

The arrangements of the components described above and the straight line path (in plan view) of the cutters 25 relative to the rock surface 21, results from the cutters 25 rotating around the carriers 14 and 15 in the same path as all other cutters 25 on the respective carriers 14 and 15. This ensures that each cutter 25 is engaging the rock with the same tip or peripheral speed, whereas the path of each individual cutter 25 is determined by the rotation of the main body 11.

The cutters, 25, at the base of the bit 10, are positioned as a result of inclined axes 17 and 18 close the longitudinal axis 22, but never cross the longitudinal axis 22. Because of the arrangement of components in FIG. 1, if the cutters 25 were to cross longitudinal axis 22, the cutters 25 on respective carriers 14 and 15 would collide. If for some reason it were desired to have the cutters 25 cross over longitudinal axis 22, preventing collision of the cutters 25 would be necessary. This might be done by the correct timing and spacing of the movement of the teeth on one carrier with respect to the other carrier.

Figure 3:
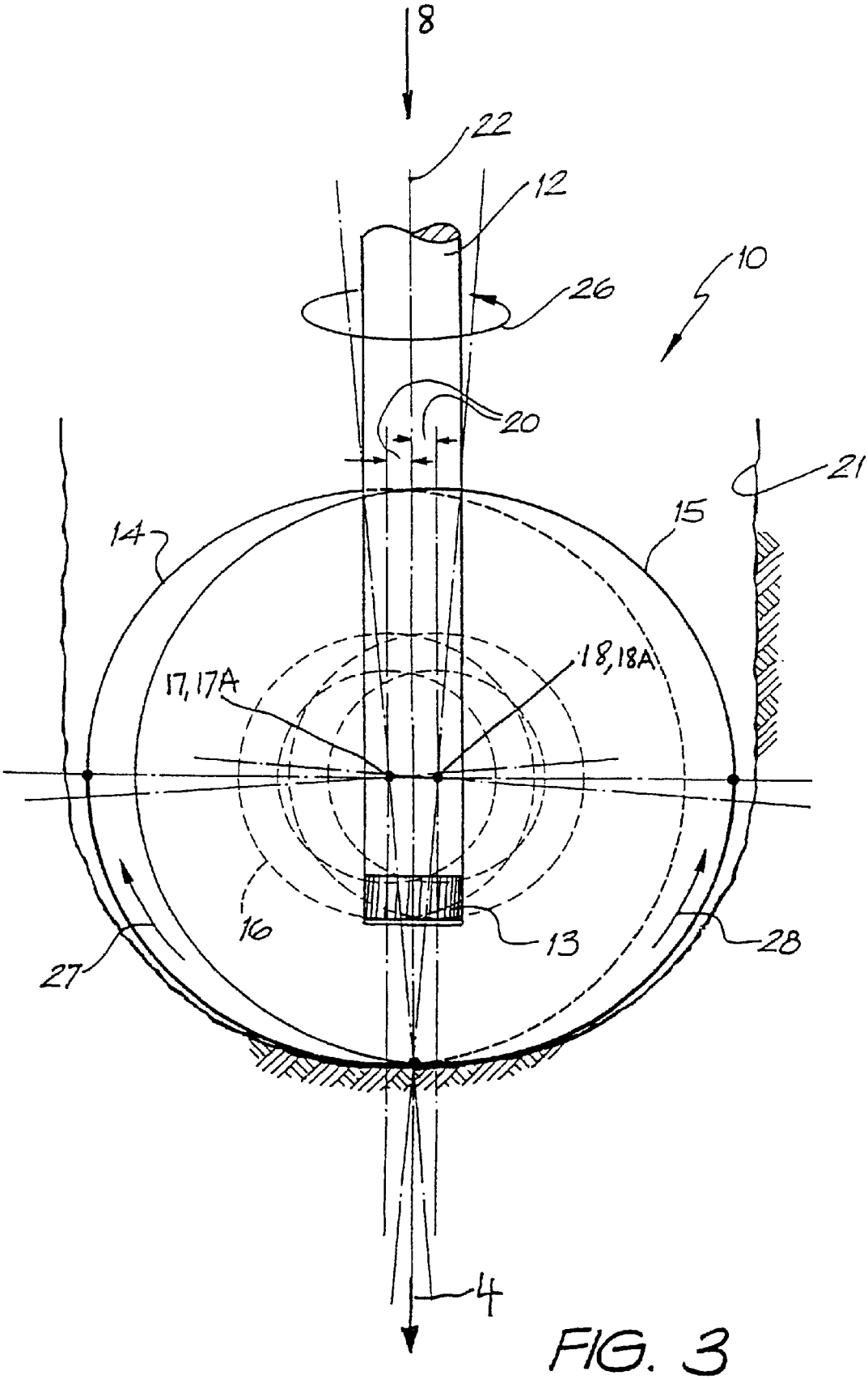
FIG. 3 is a diagrammatic side elevation of the apparatus of FIG. 1, showing the surface contact of the circumference of the bit carriers on a rock face.

As illustrated in FIG. 3, by rotating the drive shaft 12 in the direction of arrow 26, will result in a clockwise rotation 27 of carrier 14, and anticlockwise rotation 28 of carrier 15 when viewed from a direction as depicted in FIG. 3. The resultant of the vertical reactions at the sides of the bore surface 21, which results from rotation of carriers 14 and 15, produces a thrust in the direction of arrow 4 of FIG. 3, onto the bit 10, which is the direction of excavation required. If the drive shaft 12 is rotated in the opposite direction, then the thrust induced onto the bit 10 will be opposite to the direction required for excavation, providing the cutters 25 are making contact with the bore surface 21. This opposite thrust can be useful when drilling soft surfaces, because the soft surfaces can tend to choke the bit. Where as the additional ground engaging thrust resulting from contra-rotation is very useful in drilling denser surfaces. It must be pointed out that this thrust is resultant from the rotation of the drive shaft 12, whereas additional thrust may be provided directly through the drive shaft 12 in the direction of arrow 8.

Figure 5:
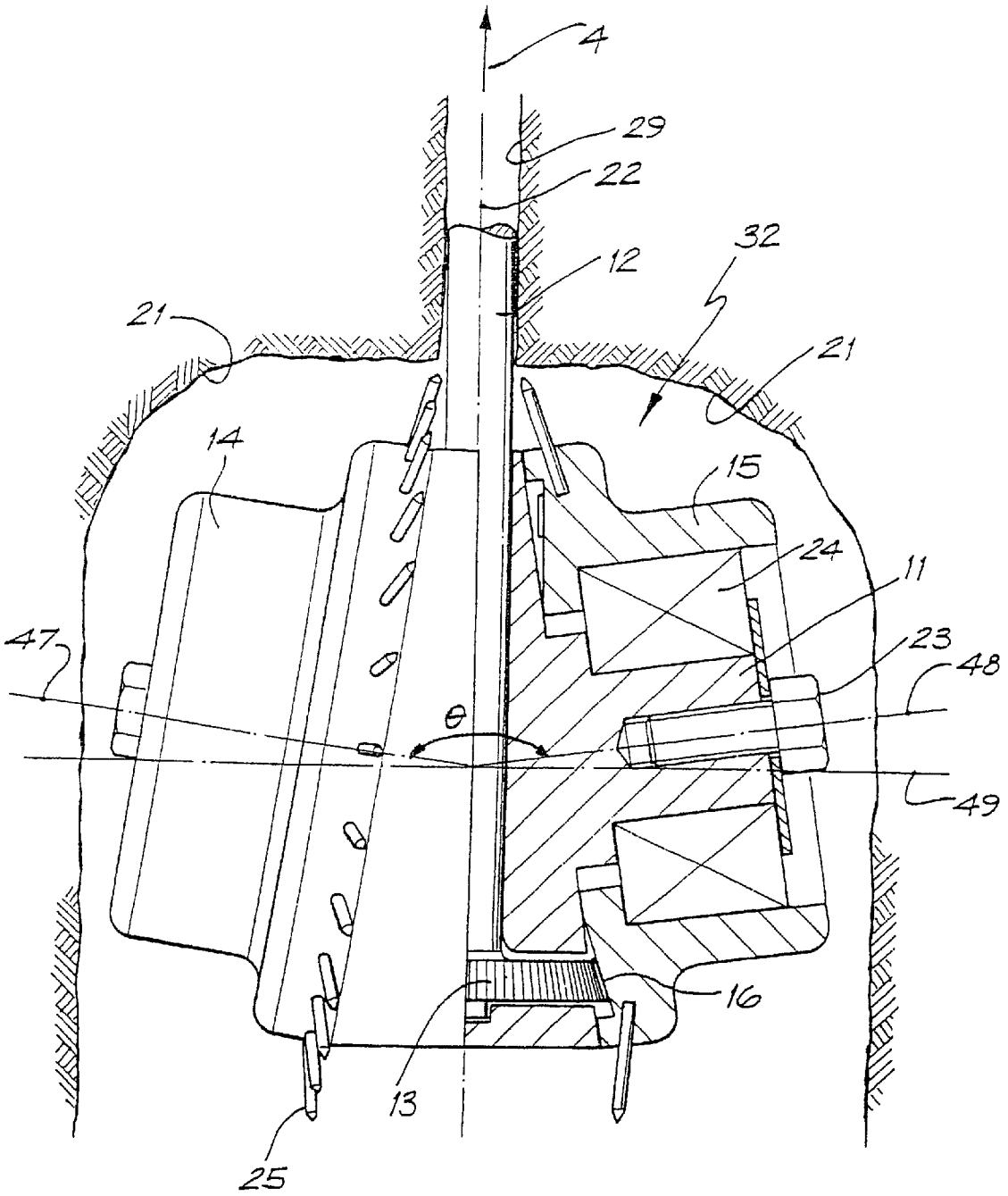
FIG. 5 is a diagrammatic front elevation and part section of the excavation bit in a reaming embodiment.

FIG. 5 illustrates a reaming embodiment 32 similar to that of FIG. 1, showing the surface to be reamed 21 after the pilot hole 29 is drilled. Pilot hole 29 also acts as a guide for the bit 32, as drill rods and drive shaft 12 are pulled through the pilot hole 29. The axes 47 and 48 of the carriers 14 and 15 are inclined above the first transverse axis 49. This allows the tips of the cutters 25 to angle toward each other and to engage as close to the pilot hole 29, without contacting the drill rod or drive shaft 12. By rotating drive shaft 12, without any externally imposed upward thrust (in direction of arrow 4), the bit 32 will thrust in the direction of arrow 4 due to the contact of the cutters 25 with the rock surface 21, and the contra-rotation of the carriers 14 and 15.

Figure 6:
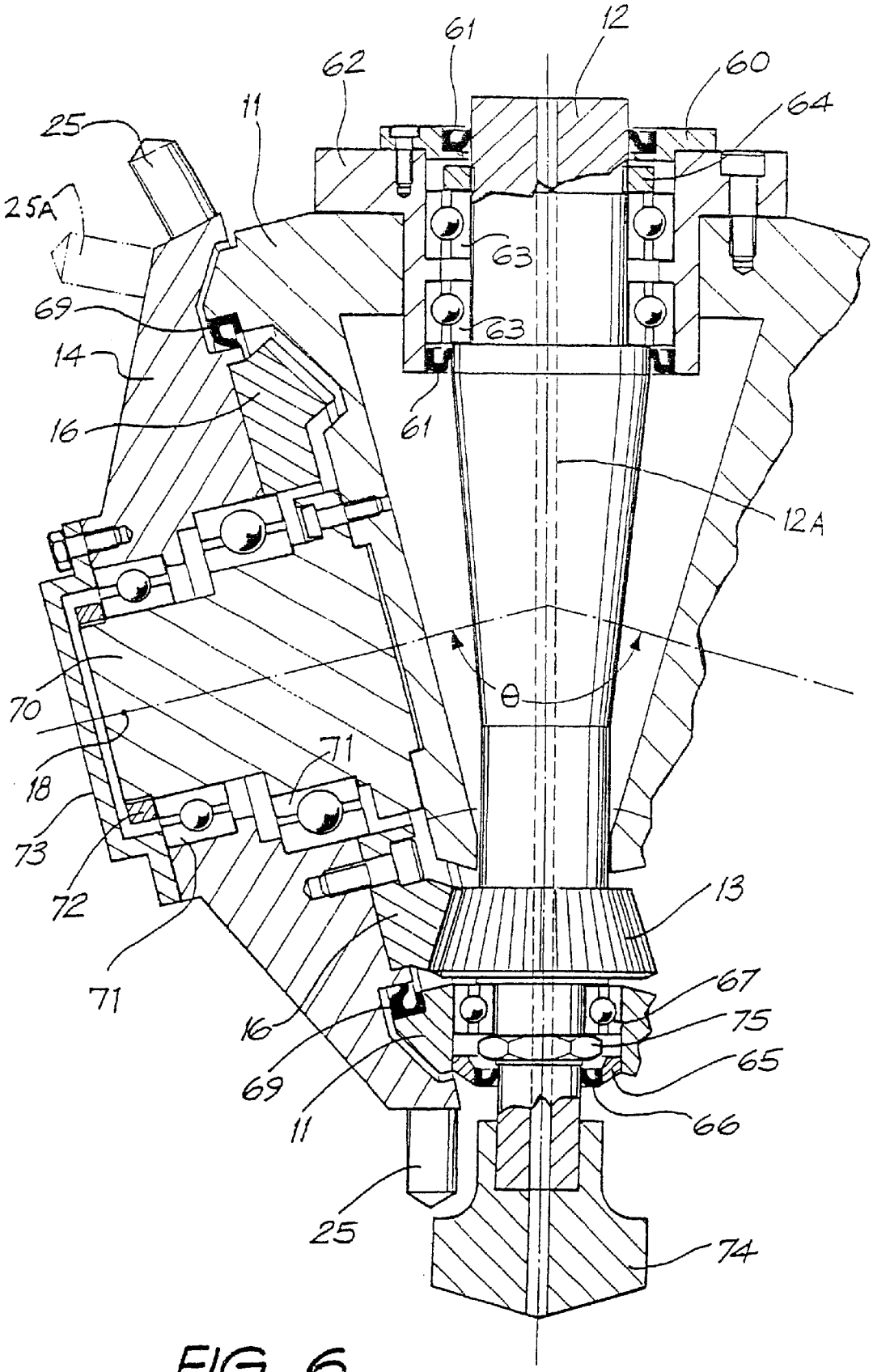
FIG. 6 is a diagrammatic cross section of another excavation bit.

In FIG. 6 of the accompanying drawings there is diagrammatically depicted a second embodiment. In this embodiment the bore engaging end of the drive shaft 12 is provided with a pilot hole bit 74. Other detail of the apparatus is substantially the same in construction and operation as that described above with reference to FIG. 1.

As depicted in FIG. 6, the apparatus includes a pair of upper bearings 63 located about the drive shaft 12 and held in position thereon by means of a bearing retaining nut 64. Bearings 63 engage with the internal annular surface of a bearing carrier 62 which is bolted or otherwise secured to the main body 11. A seal carrier 60 is bolted or otherwise secured to the bearing carrier 62 and includes an annular seal 61. Similarly, the other (internal) end of the bearing carrier 62 includes an annular seal 61 which bears against the surface of the drive shaft 12. The main body 11 includes a further annular seal 69 about its periphery near the bore engaging end. Seal 69 bears against the internal surface of a rotatable carrier 14.

A carrier, in other drawings referenced by numeral 15, is present in the embodiment of FIG. 6 but is not illustrated here. As illustrated at reference numeral 25, a plurality of cutters, cutting teeth or ground engaging bits or other excavation means are secured to the periphery of the rotatable carrier 14, at the maximum possible perpendicular distance away from the axis of rotation 17 and 18. As shown in phantom, other cutters 25A can be located adjacent these for low energy use trimming work.

Carrier 14 is mounted for rotation about axis 18 by means of axle 70 which is bolted, formed with or otherwise secured to the main body 11. A pair of bearings 71 are mounted on the axle 70 and it is by these bearings that the carrier 14 is rotatably mounted. A cover 73 is bolted or otherwise secured to the carrier 14 so as to seal and protect the axle 70 and bearing 71. A bearing retaining nut 72 is threadably engaged upon the axle 70 as shown.

The rotatable mounting of the carrier (15) on the other side of main body 11 is performed by the same method by which carrier 14 is rotatably mounted on main body 11.

It should be appreciated that the angle θ between the axes of rotation 18 and 17 can be selected so as to provide an apparatus applicable to particular drilling requirements. More will be said of angle θ later.

At the distal end of the drive shaft 12, there is provided a guide or pilot bit 74 which could drill a pilot hole during operation or follow a pre-drilled hole. Through the pilot bit 74 and drive shaft 12 is a bore 12A through which a medium is such as air or water can be pumped or vacuumed, so as to lubricate the bit and or to remove sold earth material from the bore. In the vicinity of the pilot bit 74 the drive shaft 12 is sealed to the main body 11 by a seal 66 which is mounted on the main body 11 by means of an annular seal carrier 65. The drive shaft 12 has mounted on its lower end a bearing 67 retained in position by means of a bearing retaining nut 75.

The carriers 14 and (15) are contra-rotated when the gear 13 at the end of drive shaft 12 is rotated. This results in the ring of gear teeth 16 on the carriers forcing the carriers to rotate in the same manner as in FIG. 1.

All embodiments described herein can have carriers 14 and 15 contra-rotate as a result of rotation of the drive shaft 12. However, they can be alternatively driven in opposite directions by means by a motor or motors mounted within main body 11. The motor or motors may be pneumatic, hydraulic, electric or of the internal combustion type.

The embodiments of FIGS. 1 to 3, and 6 and 7 are adapted to be driven to the end of the bore away from the rotational unit which rotates the drill rods. In this case no pilot hole is required. Whereas the embodiments of FIGS. 5 and 8 are driven to the end of the bore towards the rotational unit which rotates the drill rods. This will require a pilot bore so as to pass the drill rods through. The pilot bore will also help to guide the excavation bit, and help keep the bore on the desired path.

Figure 7:
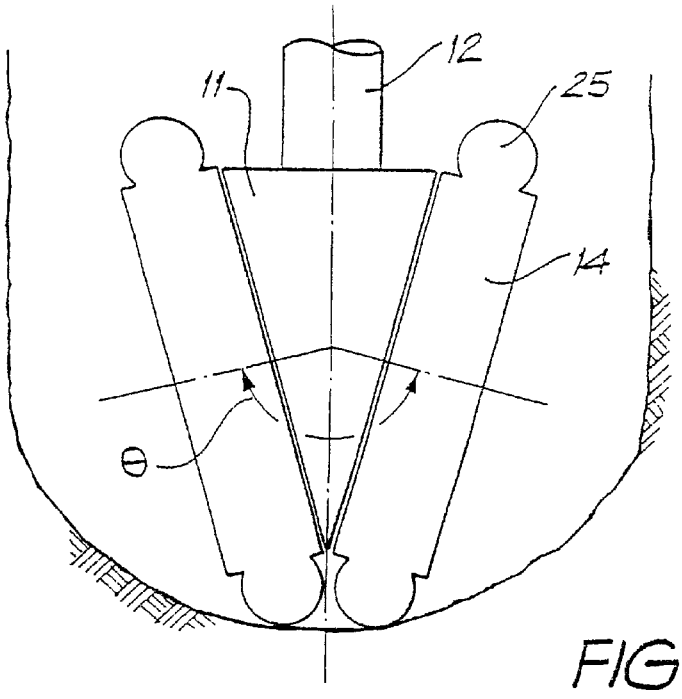
FIG. 7 is a diagrammatic front elevation of second excavation bit.
Figure 8:
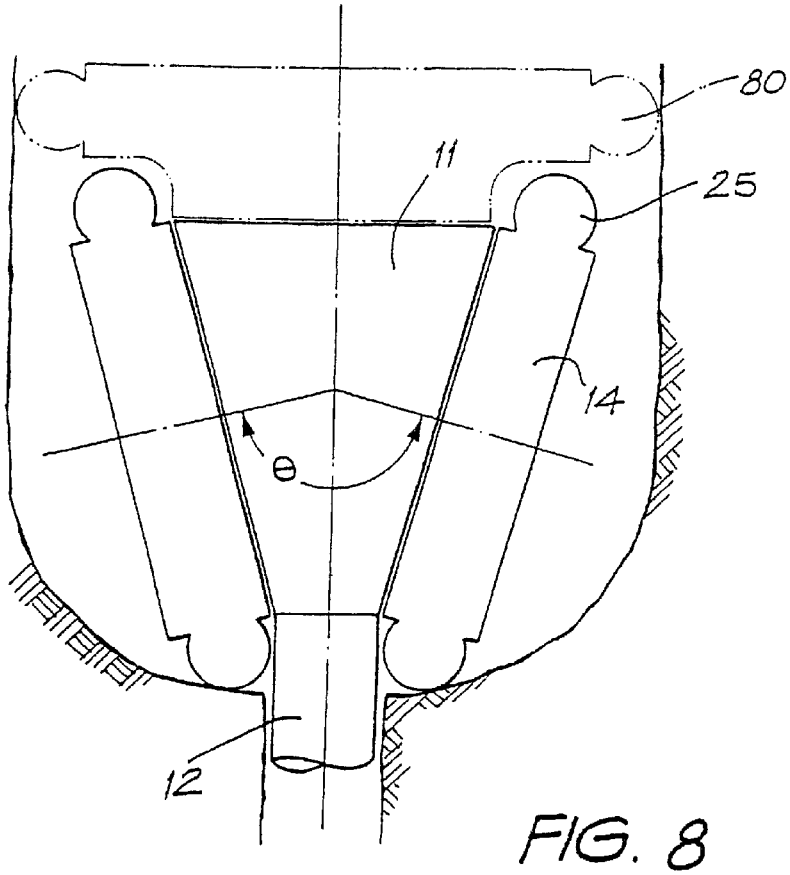
FIG. 8 is a diagrammatic front elevation of a third excavation bit.

FIG. 7 depicts an embodiment similar to those described previously except that it has cutters 25 or teeth of different profile to those previously depicted.

As shown in FIG. 8, a stabiliser 80 can be affixed to or rotatably mounted on the upper part of the main body 11. The purpose of the stabiliser is to simply engage the wall surface or other surface of the bore so as to keep the excavation bit on a desired course. Variations in density of earth could, without a stabiliser, cause the excavation bit to take the path of least resistance, and move off line. The stabiliser 80, when rotatably mounted on main body 11, can also be powered so as to be driven to rotate at the same speed as the speed of rotation of the main body 11, or at some other speed. Rotation may be in either direction.

Alternatively a stabiliser 80 can be affixed to the main body 11 so that it is not able to rotate relative to the main body 11. In which case, its rotation speed will be the same as that of the main body 11. As another alternative, the stabiliser 80 can be rotatably mounted on the main body 11 but not powered or motorised. As a final alternative the stabiliser 80 could be positioned on the drill rod as drive shaft 12 without making contact with the main body 11. The provision of such stabilisers 80 is applicable to each of the other embodiments described herein. If desired, a reamer can be substituted for the stabiliser 80, or the stabiliser 80 might simply be a member which includes a bearing surface which rotates with the main body 11.

In FIG. 9 there is schematically depicted the various points of contact of cutters 25 with the rock surface 21. In this diagram a first cutter 25, mounted on carrier 14, is shown moving from position 25B to position 25A about rotational axis 17 (into the page) in the clockwise direction indicated by arrow 27. A second cutting tooth 25, mounted on the contra-rotating carrier 15, is shown moving about rotational axis 18 (into the page) from a position 25C to the position 25D, in the anticlockwise direction indicated by arrow 28. As the cutters 25 move in the directions indicated, the reaction of the cutters 25 with the rock surface 21 provide thrust to the main body 11 and carriers 14 and 15, in the direction indicated as X. The horizontal components of the reaction force of the cutters 25 against opposing faces of the rock counteract one another, but produce a moment which results in the rotation of the main body 11 about longitudinal axis 22. It should be noted that in FIG. 9 the distance between rotational axes 17 and 18 is the offset of one axis of rotation relative to the other and is made up of the two offset distances 20.

Figure 10:
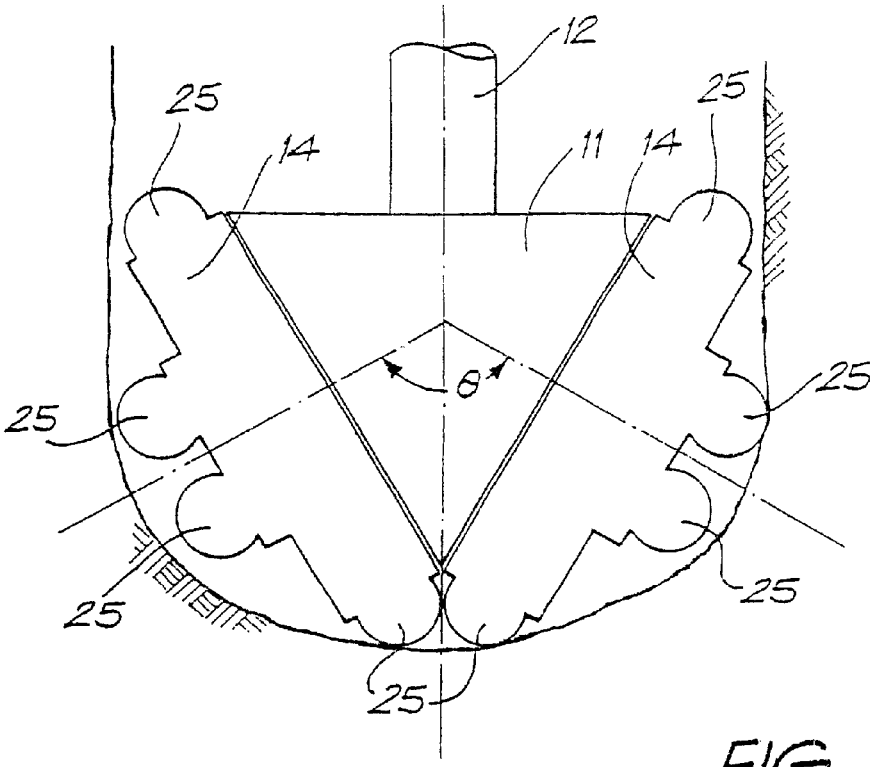
FIG. 10 is a diagrammatic front elevation of a fourth excavation bit.

FIG. 10 illustrates a fourth embodiment wherein the angle θ is approximately 120°. In this embodiment, there are provided additional cutting teeth 25, which are mounted on side surfaces of the carrier 14, or if desired, they could also be mounted onto cover plate 73. These additional cutters assist in providing additional stability to the excavation bit, as it is excavating.

The angle θ affects the relationship between the torque in drive shaft 12 and the pushing effect of the cutting teeth 25 against the rock. If the angle θ high, but less than 180° then the main body 11 will rotate by virtue of the reaction forces resulting from cutter engagement, to produce a moment about the longitudinal axis 22. As the angle θ decreases in size, the pushing effect increases and rotation speed increases. Simultaneously, as the angle θ decreases, so does the magnitude of thrust (in direction of arrows 4 (FIG. 3) or arrow X (FIG. 9), produced by the contra-rotation of the carriers 14 and 15. The most preferred balance of thrust, rotation speed, and pushing effect of teeth is achieved when θ is in the range of 90° to 150°.

Figure 11:
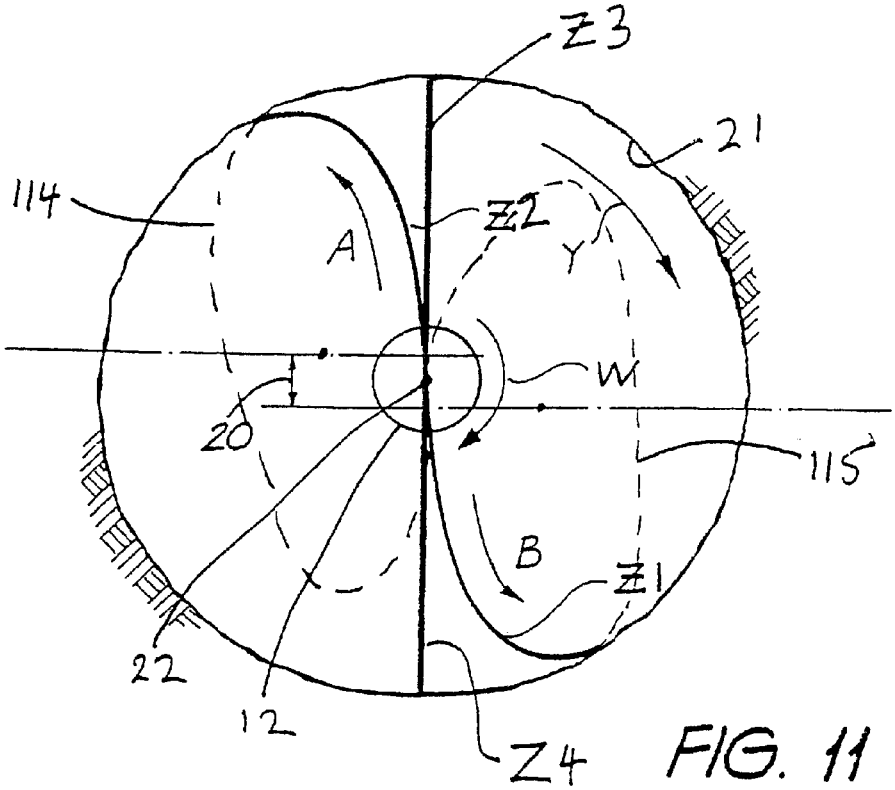
FIG. 11 is a schematic plan showing the line of contact of the cutters of FIG. 10 with a rock surface (and is similar to FIG. 4).

FIG. 11 illustrates the direction of cutter movement of a clockwise rotation embodiment. In this embodiment, it will be noted that the carrier 114 is at the left hand side of FIG. 11, but engages the bore 21 at the top of the figure. Whereas carrier 115 is at the right hand side of FIG. 11, but engages the bore 21 at the bottom of the figure. This is an opposite or mirror image arrangement to that of FIG. 4. In FIG. 11 it can be seen that rotation of the drive shaft 12 in the direction W results in the rotation of carriers 114 and 115 in the directions of A and B, respectively, which produces rotation of the main body in the direction of arrow Y, and that the arrow Y has the same sense or direction as that of direction W.

In FIG. 11, bold lines Z1 and Z2 represent the possible points of contact or engagement of cutters 25 mounted on the carriers 115 and 114 respectively, at any single point in time. Because of angle θ and the offsets and positional arrangement of the carriers 114 and 115 relative to main body (not illustrated), once the carriers 114 and 115 are driven by drive shaft 12 being rotated in the direction of W, the main body will rotate in the direction of arrow Y, and respective cutters 25 on respective carriers 114 and 115, will begin their engagement with the ground near to longitudinal axis 22. However, because of the revolving of the cutter 25 around the circumference of the respective carriers 114 and 115, which carriers are each at an angle of θ/2 to the longitudinal axis 22, there results a substantially line engagement indicated by bold straight lines Z4 and Z3 respectively of those cutters, with the rock surface 21. This path line of the cutters may be straight when viewed in plan view, as depicted in FIG. 11, if the angular speed of the cutter around the carrier, in a plane perpendicular to the longitudinal axis 22, is equal to the angular speed of rotation of the main body 11 in the opposite direction, in the same plane.

From FIGS. 4 and 11, it will be seen that the carriers 14 and 15, or 114 and 115, are positioned according to whether the particular excavation bit is required to be operated by the drive shaft 12, being driven in a clockwise or anti-clockwise direction. The carriers 14 and 15, or 114 and 115 are positioned so that the necessary excavation directed thrust is produced. Thus, the excavation bit assembled so that carriers 14 and 15 are as illustrated in FIG. 4, cannot function to excavate if its drive shaft 12 were rotated in a clockwise direction. Also the excavation bit of FIG. 11 could not properly function if its drive shaft were rotated in an anti-clockwise direction.

Figure 12:
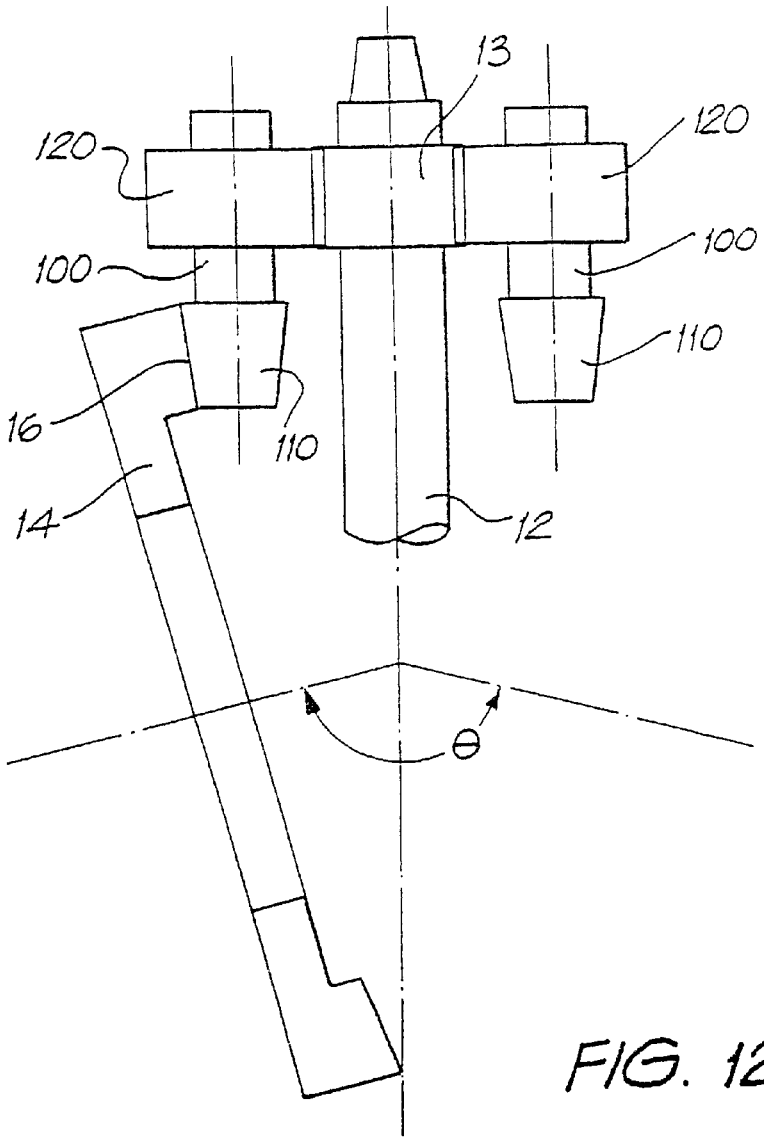
FIG. 12 is a diagrammatic elevation of an alternative drive arrangement.
Figure 13:
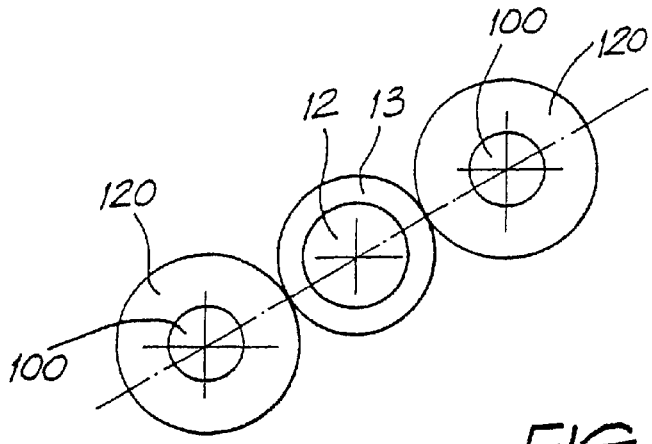
FIG. 13 is a diagrammatic plan of the arrangement of FIG. 12 with carrier 14 absent.

In each of the embodiments of FIGS. 1 to 3, 5 and 6, it is difficult, though not impossible to machine the gear teeth on the pinion gear 13, due to unconventional gear tooth profile requirements. To avoid this problem, an alternative method of driving the carriers 14 and 15 is illustrated in FIGS. 12 and 13. In FIG. 12 there is illustrated a pair of auxiliary shafts 100, which are rotatably mounted to the main body 11. Each auxiliary shaft 100 includes an auxiliary gear 120 which meshes directly with a gear 13 mounted upon the drive shaft 12. It will be appreciated that the gear teeth on gears 120 and 13 can be conventionally cut as helical or spur gears for example. Each auxiliary shaft 100 comprises a pinion 110 which engages a bevel gear 16 of the carrier 14 and 15 (the latter not illustrated). The arrangement of the gears 120 and 13 is illustrated in plan in FIG. 13. Other gear arrangements could be used to alleviate this difficulty.

Figure 15:
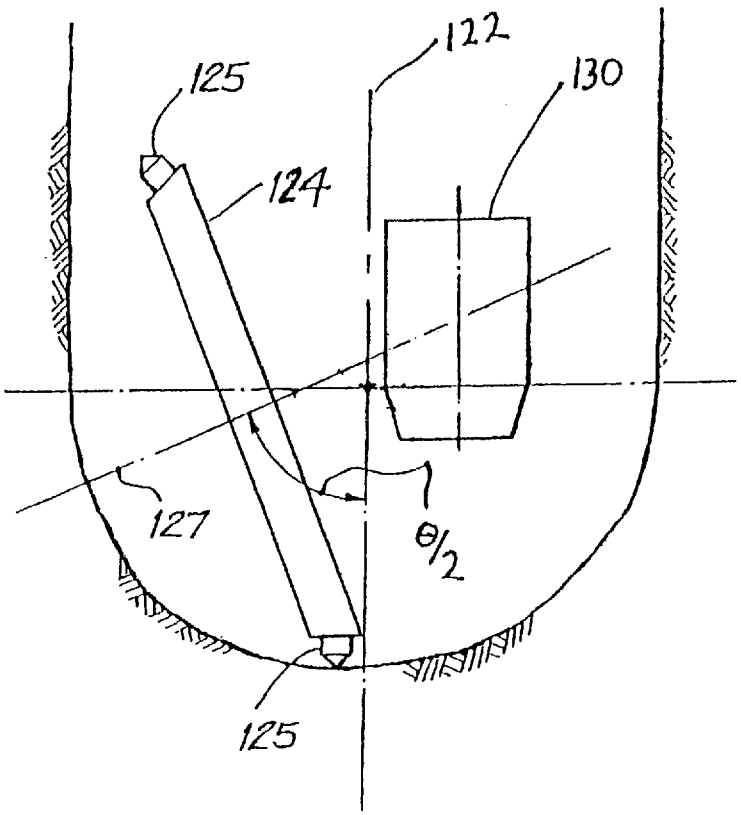
FIG. 15 is a schematic front elevation of the apparatus of FIG. 14.
Figure 14:
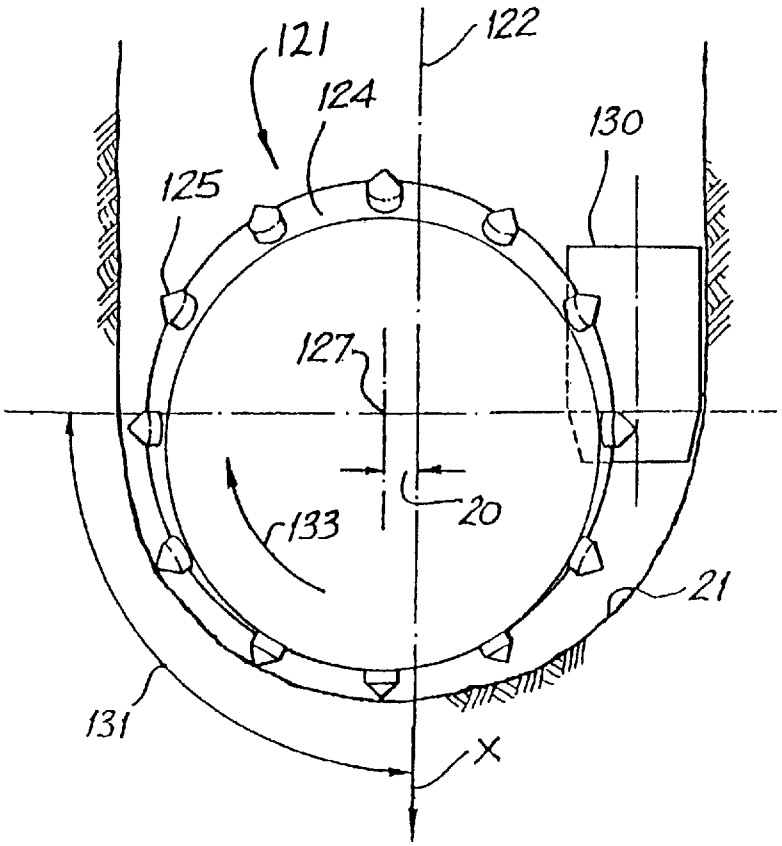
FIG. 14 is a schematic side elevation of an excavation bit having only one carrier and a mid mounted reaction roller.

Illustrated in FIGS. 14 and 15 is a schematic side and front elevation respectively, of a single carrier excavation bit 121, which has a single carrier 124 being annular and disc shaped, like in previous embodiments. The carrier 124 is rotatably mounted to a main body (not illustrated in these figures but similar to body 11 of previous embodiments) through which a drive shaft passes in similar fashion to drive shaft 12 of previous embodiments. The bit 121 is constructed in much the same way as previously described embodiments, except that a second carrier and the associated drive train are not included. The carrier 124 can have the same angular orientation and positional characteristics of other embodiments. For example, the angle θ of previous embodiments is halved and is represented in FIG. 15 by θ/2. Also the axis of rotation 127 is offset from the longitudinal axis 122 of the drive shaft and drill rod, by an offset distance 20.

FIGS. 14 and 15 include a reaction roller 130 rotatably attached to the main body (which is not illustrated) so as to rotate around an axis which is substantially parallel to the longitudinal axis 122. It is located so that as the carrier 124 and the cutter 125 contact earth 21, the reaction roller 130 engages the bore wall. If only one reaction roller 130 is utilised it is preferably located on the main body so that it is positioned diametrically opposite to theoretical point of application of the sum of the forces in the horizontal plane of the cutters 25 with the rock surface. If two or more rollers 130 are used then they should be equidistant from this point. This will prevent the carrier 124 and cutter 125 from retreating from the bore and wall 131 portion being excavated. As can be seen from FIG. 14, the carrier 124 contacts the arc 131 of bore surface 21, while at the same time, reaction roller 130 engages the opposite side of the bore surface. Because of the positional relationship of these components in the bore, there will result an excavation directed thrust in the direction X by the rotation of carrier 124 in the clockwise direction of arrow 133.

Figure 17:
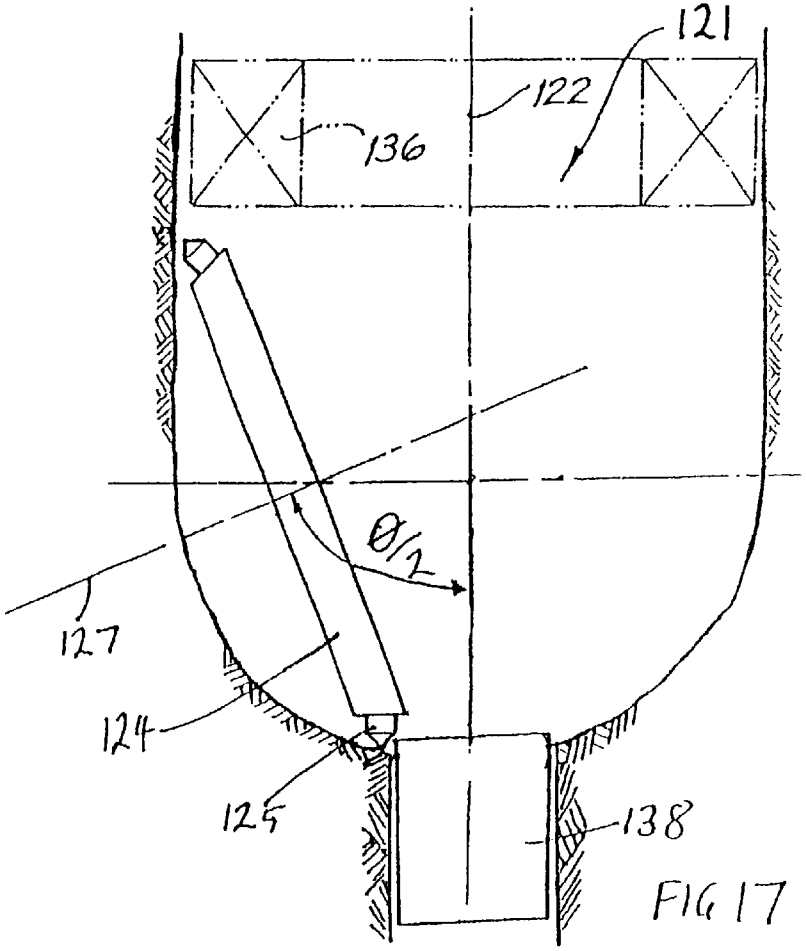
FIG. 17 is schematic front elevation of the apparatus of FIG. 16.
Figure 16:
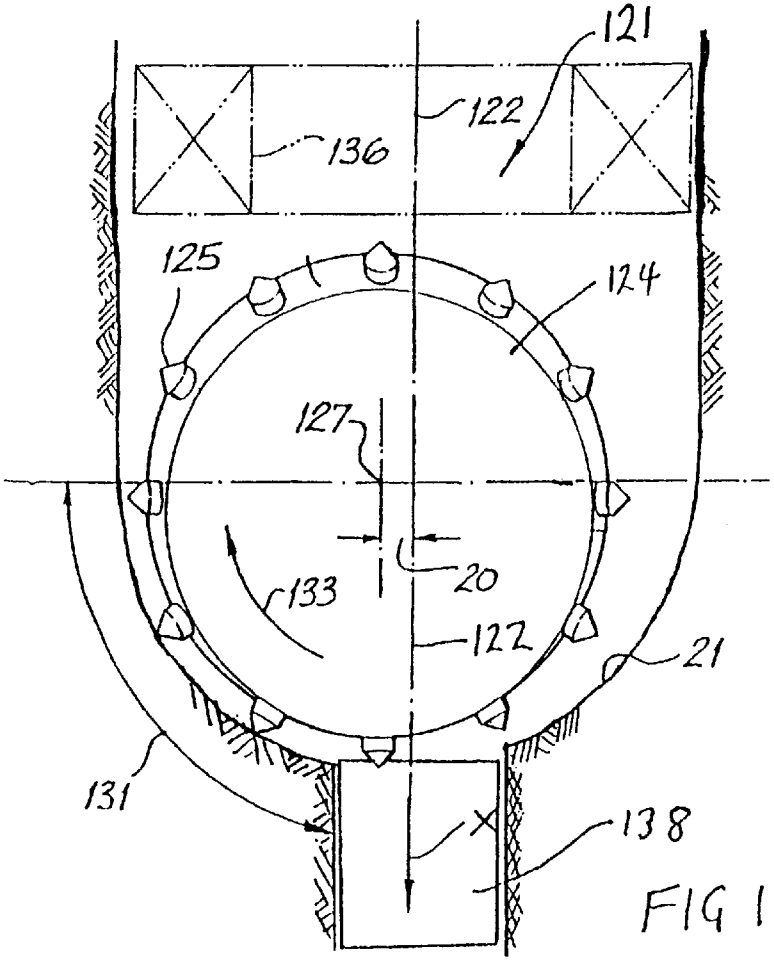
FIG. 16 is a schematic side elevation of an excavation bit having only one carrier and a top and or bottom mounted reaction roller.

The embodiment of FIGS. 16 and 17 is similar to that of FIGS. 14 and 15, except that reaction roller 130 is replaced by annular reaction roller 136 (illustrated in phantom line) is mounted for rotation on the top of the main body, to which the carrier 124 is mounted.

In addition to, or as an alternative to, reaction roller 136 another reaction roller 138 can be associated with an adjacent pilot bit such as that illustrated in FIG. 6.

If desired all three reaction rollers 130, 136 and 138 could be present in the one excavation bit, and more than one of each type could be utilised. The reaction rollers can be positioned in any appropriate position on the main body to counteract the transverse components of the reactive forces of the cutting teeth with the rock face, so as to engage and react with the opposing rock face.

While a roller is preferable for the reaction rollers 130, 136 and 138, they could be substituted by a reaction member which does not rotate about its own axis, but simply rotates with the main body and provides a bearing surface to counter the reaction forces which tend to move the carrier away from the rock surface being excavated.

The above described dual carrier embodiments of FIGS. 1 to 13 fall into two categories of construction:

CATEGORY A-generally represented by embodiments of FIGS. 1 and 6 wherein the pinion 13 is located at the end of the main body 11, near to which convergence of the carriers 14 and 15 occurs. In the case of FIGS. 1 and 6 this at the lower end of the body. This category is not dependent upon whether the excavation bit is used in conventional or reaming operations.

CATEGORY B-generally represented by the embodiment of FIG. 5 wherein the pinion 13 is located at or near the end of the main body 11, which is opposite to the end near to which convergence of carriers 14 and 15 occurs.

Category A excavation bits will produce main body rotation in the same direction as the rotation of the drive shaft 12, when cutters 25 are engaging the ground.

Category B however, will produce rotation of main body 11 which is in the opposite direction to that of the rotation, when the cutters 25 are engaging the ground.

If category A excavation bits are utilised, then a positive effect results from the friction of, or in, the drive train of the excavation bit, assisting the main body 11 rotation. This assistance occurs because the frictional force is additive to the forces which rotate the main body 11.

However, a negative effect also results, in that as the carriers 14 and 15 (and cutters 25) encounter higher load or resistance from the earth or rock, the speed of the cutters 25 relative to the rock face will decrease. This decrease in speed of the cutters 25 relative to earth will result in a proportional decrease in the rotational speed of the main body 11. The reduction in the rotational speed of the main body 11 will increase the speed of the drive shaft 12 relative to the main body 11 which in turn results in a decrease of available torque.

Thus if an excavation bit of category A is utilised, sufficient power must be delivered to the drive shaft 12, to prevent stalling.

If category B excavation bits are utilised, then a negative effect results from the friction of, or in, the drive train of the excavation bit, hindering the main body 11 rotation. This hindrance occurs because the frictional force is subtractive to the forces which rotate the main body 11.

However, a positive effect also results, in that as the carriers 14 and 15 (and cutters 25) encounter higher load or resistance from the earth or rock, the speed of the cutters 25 relative to the rock face will decrease. This decrease in speed of the cutters 25 relative to earth will result in a proportional decrease in the rotational speed of the main body 11. The reduction in the rotational speed of the main body 11 will decease the speed of the drive shaft 12 relative to the main body 11 which in turn results in an increase of available torque.

Thus if an excavation bit of category B is utilised, a manufacturer must ensure that the friction force of, or in, the drive train of the excavation bit, does not overcome or negate the forces which would rotate the main body 11, by increasing the angle θ (see paragraph after next).

If an in built drive mechanism is used, such as a motor or motors built into the main body 11 as described above, these positive and negative effects of category A and B excavation bits will not occur because the drive speed will be substantially constant.

Referring now to FIG. 18, the following effects of the size of angle θ are exhibited irrespective of whether a single or dual carrier is present:

(i) when the angle θ has a high value, i.e. >than 90° the following results:
  (a) a high thrust (in the direction of arrow 4 of FIGS. 3 and 5, and arrow X of FIGS. 9, and 14 to 17) is derived from the rotation of the drive shaft 12; and
  (b) a low rotation force is applied to the main body 11 to cause rotation of main body 11.

(ii) when the angle θ has a low value, i.e. less than 90° the following results:
  (a) a low thrust (in the direction of arrows 4 of FIGS. 3 and 5, and arrows X in FIGS. 9, 14 to 17) is derived from the rotation of the drive shaft 12; and
  (b) a high rotation force is applied to the main body 11 to cause rotation of the main body 11.

These effects are summarised in FIG. 18 where thrust is represented by the intermittent or dash line and body rotation is represented by the continuous line. FIG. 18 is not a graph of results, rather is a simplified schematic of what is expected. By these effects of the angle θ, the angle θ can be selected so as to produce an appropriate amount of thrust and rotation depending upon the type of material being excavated by the bit. For example in soft materials the angle θ may need to be selected so as a low value, because a high thrust is not required, but a high rotation force of the bit is required. Similarly in hard materials the angle θ can be high value, because a high thrust is required and a low rotation force is needed.

Figure 19:
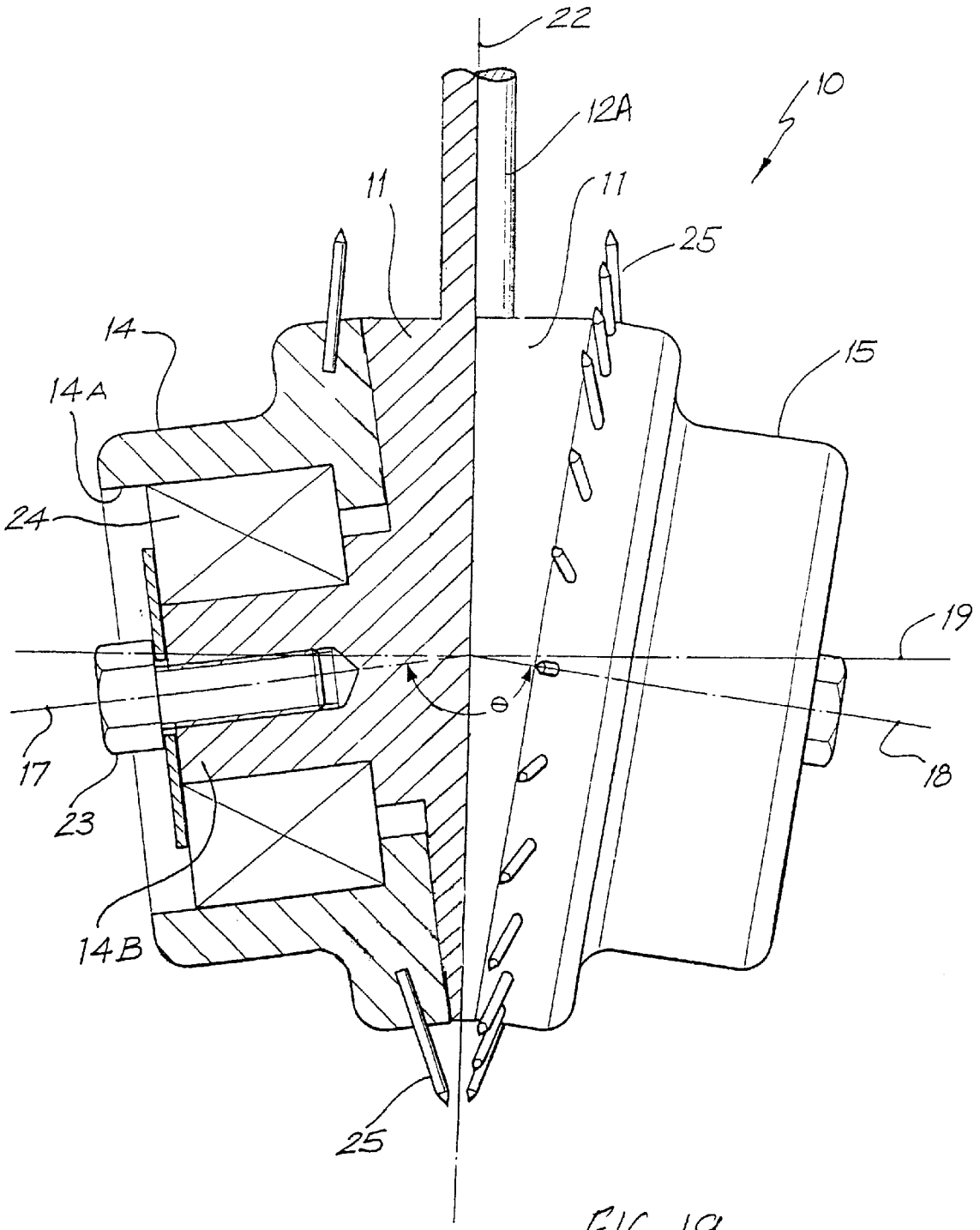
FIG. 19 is a diagrammatic front elevation of an excavation bit where the cutter body is not rotatable relative to the drill rod.

Illustrated in FIG. 19 is an excavation bit similar to that of FIGS. 8 and 10 (and similar to FIG. 1) where the cutter body is not able to rotate relative to the drill rod. The embodiment of FIG. 19 is similar in form to that of FIG. 1 and like parts are like numbered.

The difference between the embodiments of FIG. 19 and FIG. 1, is that in FIG. 19 a drill rod connector 12A is rigidly connected to the main body 11. The drill rod connector 12A has a tapered thread fitting (not illustrated) to mate with a drill rod. This constructional difference means that the cutter body 11 is rotated directly by a drill rod. The cutter body 11 and its rotation will cause the cutters 25 and thus the carriers 14 and 15 to rotate about their axis of rotation 17. The excavation bit 10 of FIG. 19 will operate in much the same manner as the previously described embodiments in respect to the cutting actions.

However, it is thought that due to frictional influences and slippage on the cutters, and thus the carriers, the path of the cutters will not be as substantially straight as in the above described embodiments where the cutters are directly gear driven. That is the path will be approaching straight and may have a greater degree of variation. Notwithstanding, the cutter path will be considerably straighter than prior art devices and to all intents and purposes to a person skilled in the art, will be usefully efficient in its cutter path and provide all the advantages which flow from that type of path.

Figure 20:
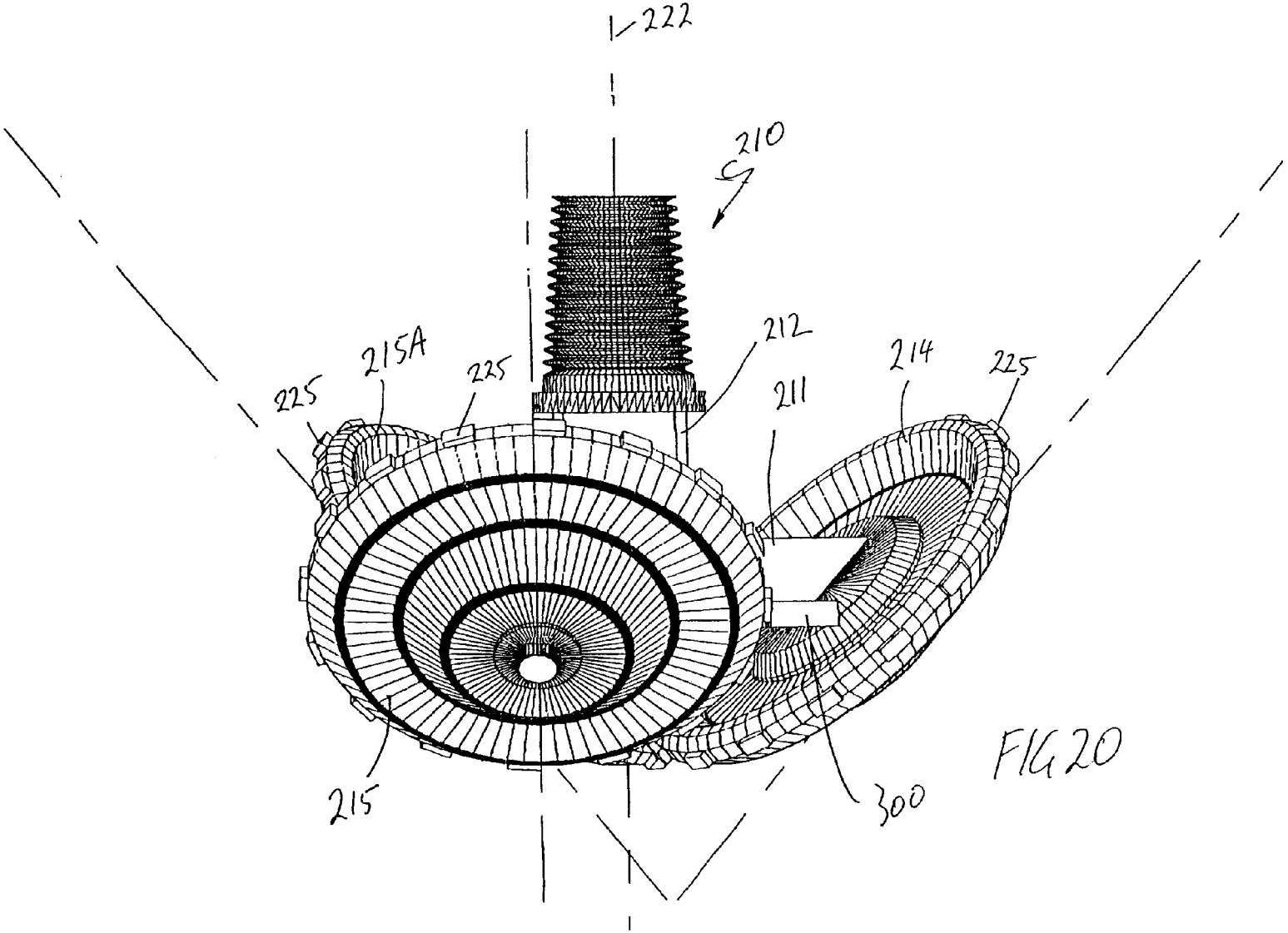
FIG. 20 illustrates a side perspective view of an excavation bit having 3 rotating carriers.
Figure 24:
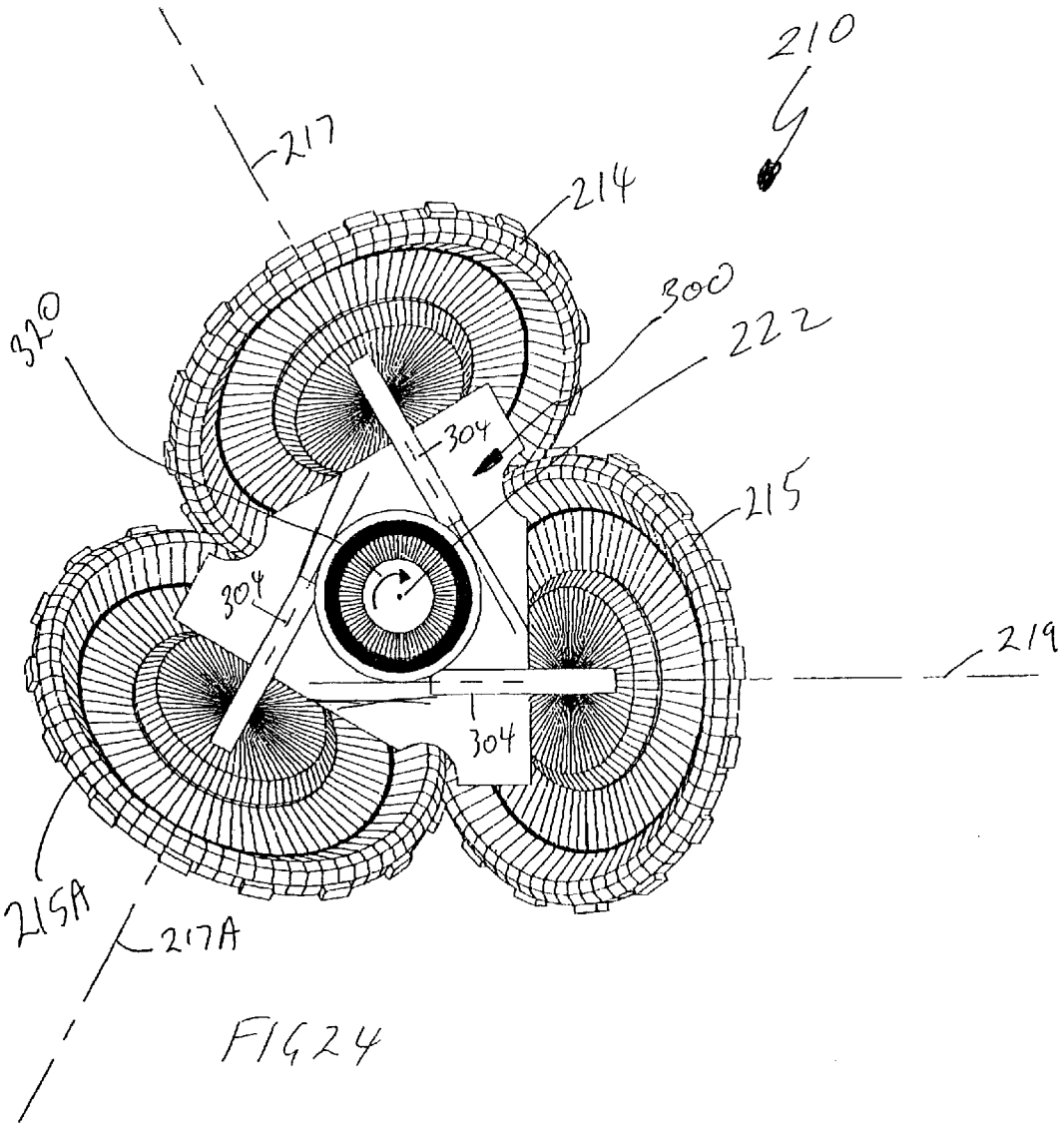
FIG. 24 illustrates a plan view of the apparatus of FIG. 20.

Illustrated in FIGS. 20 and 24 is an excavation bit 210 and parts in these drawings similar to FIGS. 1 and 19 have been given a 200 series number, e.g., the bit is numbered 10 in FIGS. 1 and 19, where as the bit is numbered 210.

The bit 210 has a main body 211 which provides 3 axes of rotation 219, 217 and 217A (visible in FIG. 21) for respective carriers 215, 214 and 215A. The illustration of FIG. 22, has carriers 214 and 215A removed for illustration purposes. It can be seen from FIG. 22 that the carrier 215 has its axis of rotation at an angle θ/2 (θ being referred to in discussion above) to the axis of rotation 222 of cutter body. Each of carriers 214 and 215A is also at the same angle. This angle is measured when the carrier 215, 214 or 215A is viewed front/rear on as in FIG. 22, as it must be remembered that the axis of rotation 219 is offset from the longitudinal axis of rotation 22 of the main body 211 and thus these two axes do not intersect.

Figure 21:
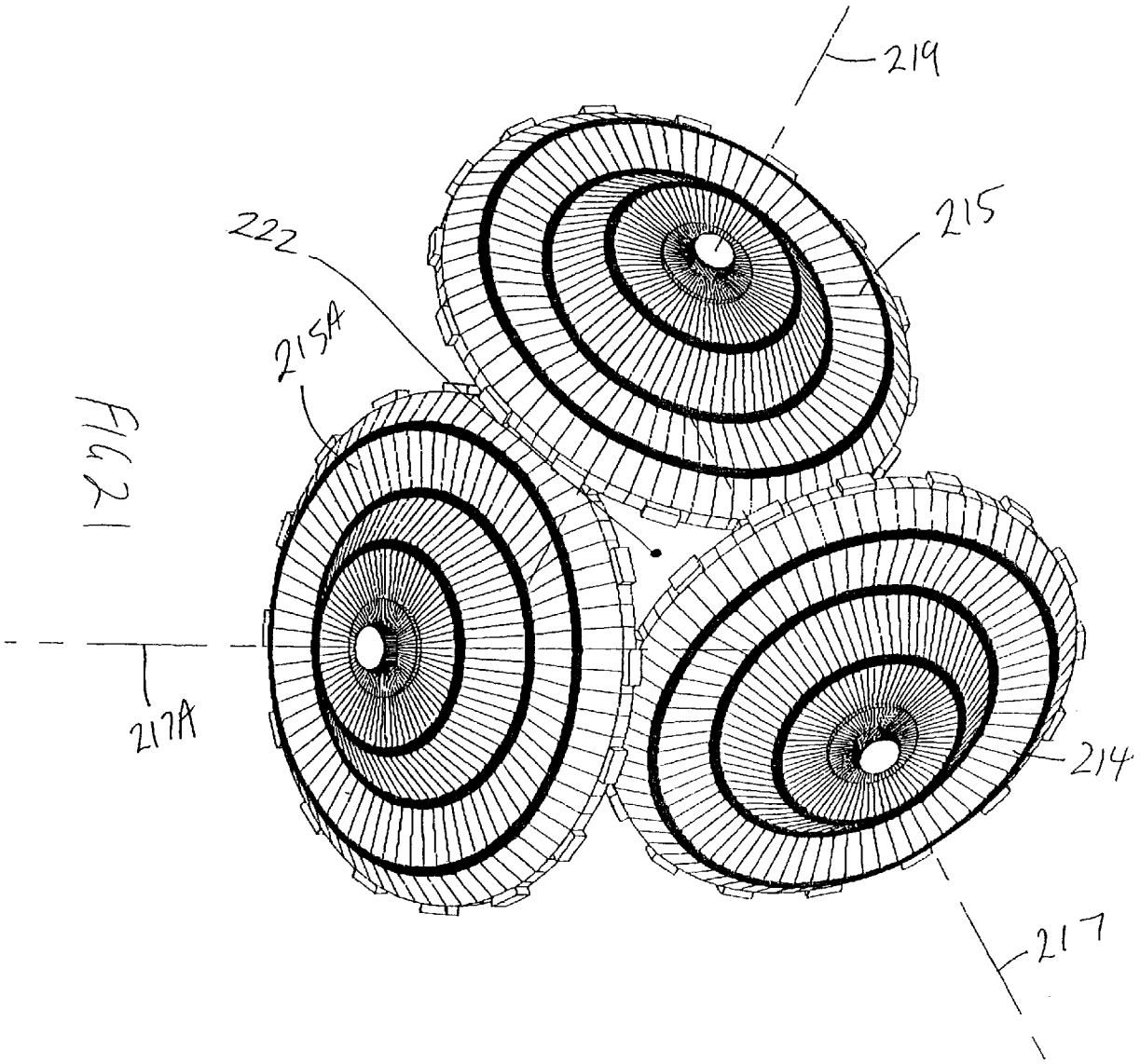
FIG. 21 illustrates an underneath view of the apparatus of FIG. 20.
Figure 22:
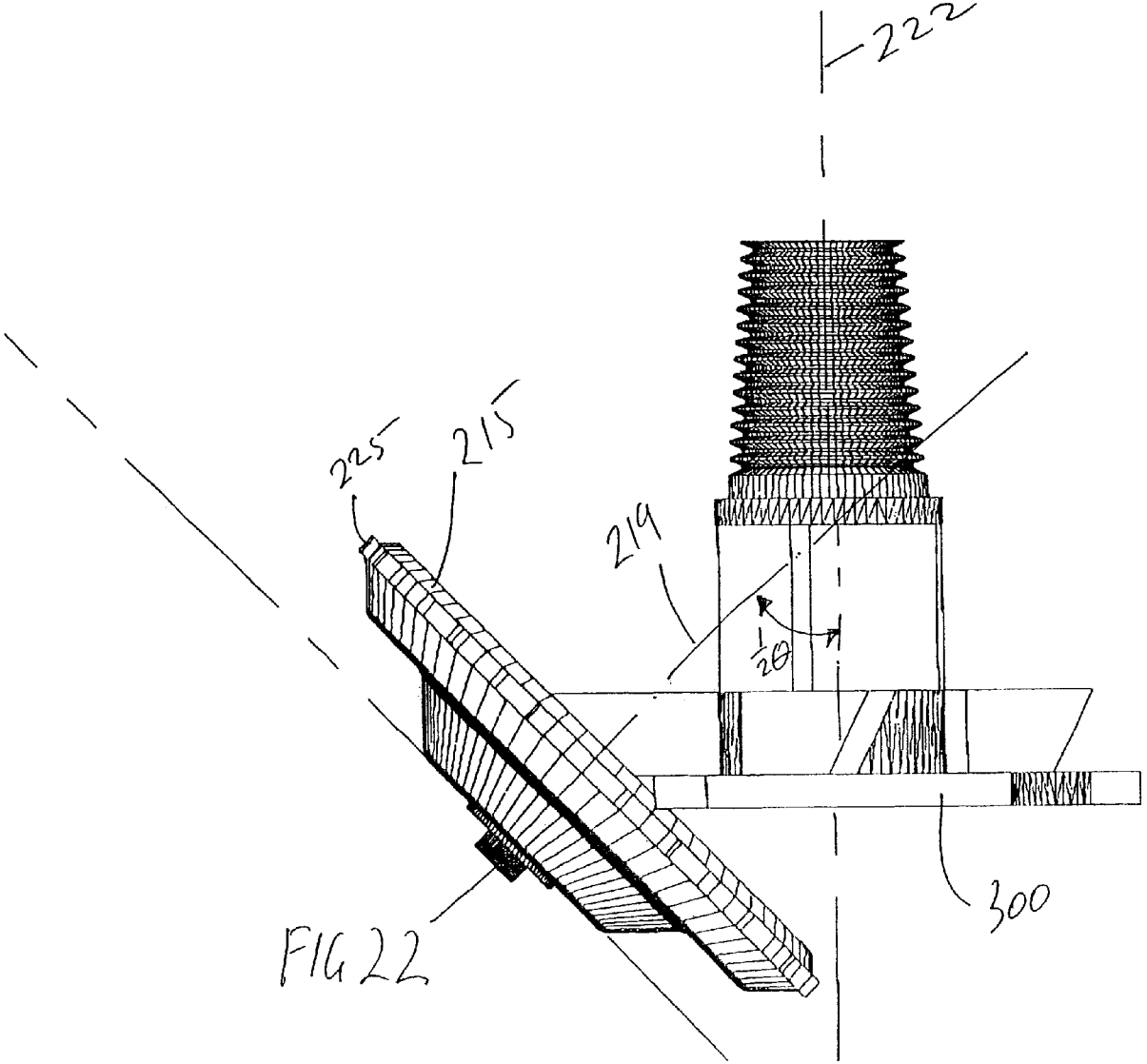
FIG. 22 illustrates a side view of the apparatus of FIG. 20, with two carriers removed.
Figure 23:
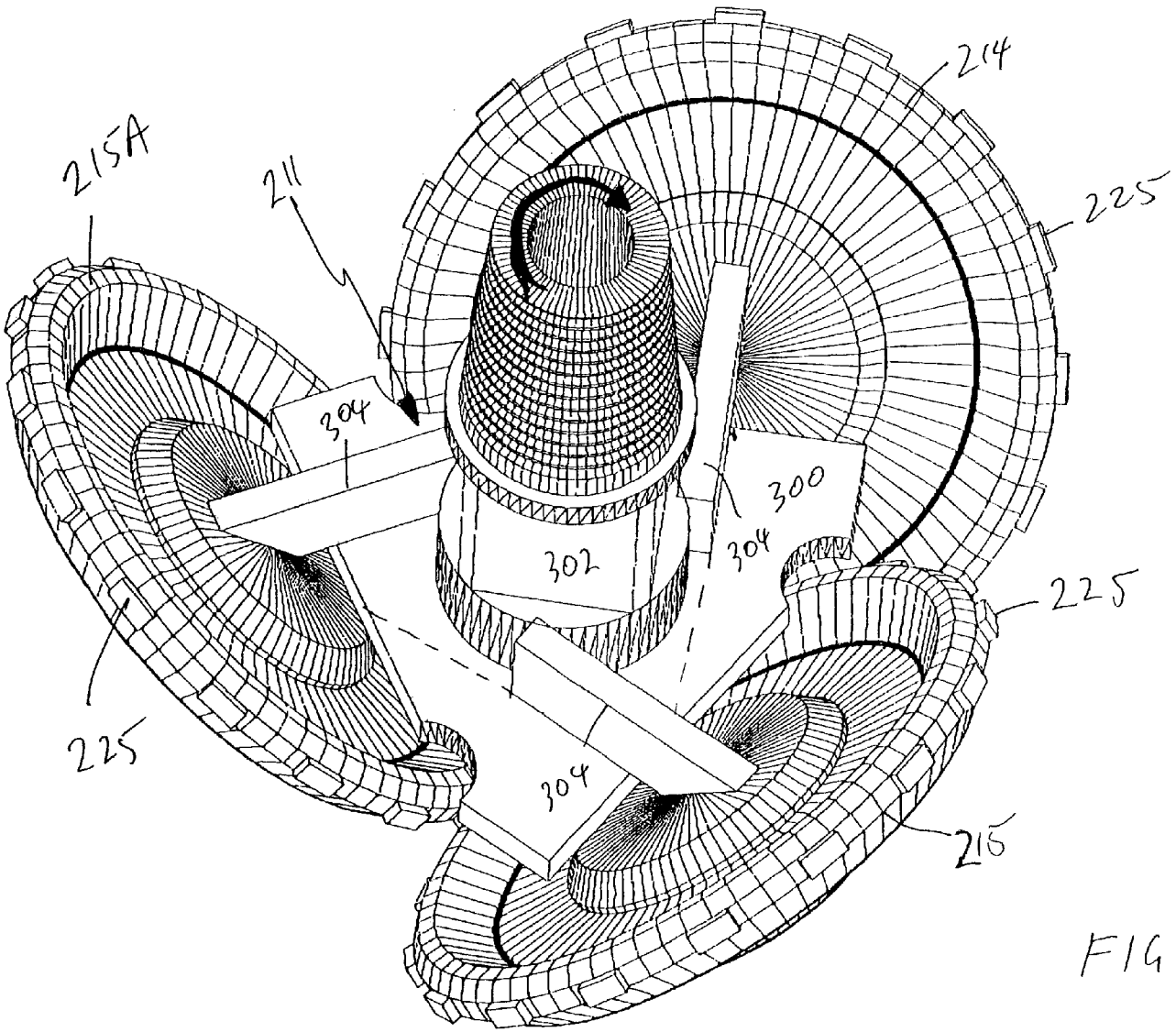
FIG. 23 illustrates a top perspective view of the apparatus of FIG. 20.

As can be seen from FIG. 21 the carriers 215, 214 and 215A are angled so as to position the cutter 25 at the lower most point as the carriers with 215, 214 and 215A being as close as possible to the axis of rotation 222 of the cutter body 211. As can been seen from FIG. 22 the cutter is closest to the axis of rotation 222 in a direction away from the main body 211 in the direction that excavation will occur.

Positioning the cutters 25 as close as possible to the axis of rotation 222 ensures that a central column of earth does not remain. The size or diameter of a central column if kept to a minimum will not cause problems, as it will or should collapse regularly, having regard to the size of the excavation bit 210 and due to the operations and machinations of the excavation bit.

The cutter body 211 includes a base plate 300 secured to the central spigot 302. Extending laterally across the base plate 300 are three axis supports 304 which provide rotational connection in the form of an axles and bearings which are not illustrated.

As can best be seen from FIG. 24 the axes of rotation 217, 217A and 219 are laterally offset from axis 222 and do not intersect with the rotation axis 222. The lateral offset of each axis of rotation 217, 217A and 219 relative to the rotation axis 222, when viewed from each axis of rotation 217, 217A and 219 is in the same direction as the direction of rotation (in this case arrow 320) of the main body 300 when the excavation bit is used to excavate.

The geometry of this bit 210 with relation to the lateral offset is the same as the geometry for all the previously described embodiments.

While FIG. 19 illustrates a two carrier embodiment, and FIGS. 20 to 24 illustrate a three carrier embodiment it will readily understood that a single carrier embodiment similar to FIGS. 14 and 15 or 16 and 17 having an idling carrier can be manufactured. Also, if desired embodiments having more than 3 carriers can be developed.

It is not understood completely why the embodiments of the invention work. One theory is that by the arrangement of the carriers on the main body, thrust applied (either via the drill rod or from the rotation of the carriers) is thought to be, through a quasi lever system, multiplied at some of the ground engaging tools in the radial direction. That is, the total thrust in the longitudinal axis direction (whether externally applied or resultant from the rotation of the carriers), is multiplied so that the outward forces exerted (by the cutters onto the rock surface in the region approaching perpendicular to the longitudinal axis of the bore) is thought to be significantly higher than the magnitude of the total thrust. It has been noticed in tests conducted of the excavation bit, that because the cutters all engage the ground first in the region of the longitudinal axis, this area of the bore is excavated relatively quickly because many teeth run over the same area. As a result, the thrust forces are thought to be borne by the side walls of the bore, and not the base of the bore. Because of this the force system on the bit thus becomes analogous to the force system of a horizontal cable secured at each end, and onto the centre of which is applied a vertical load, which results in the forces in the directions of the cable being very high, by comparison to the load itself. Thus the reaction forces will be high.

The foregoing describes several embodiments of the invention and modifications, obvious to those skilled in the art, can be made thereto without departing from the scope of the present invention. For example, the motor means, preferably a drill rod, may also be an in-built rotor performing the same task as the drill rod.

What is claimed is:

1. An excavation bit for attachment to a drill rod comprising:

a main body having a rotational axis which is coaxial with a longitudinal axis of the drill rod when connected to said bit;

at least one carrier rotatably connected to said main body and having a means for excavating positioned about its periphery, each carrier having an axis of rotation at an angle to the main body rotational axis when said carrier is viewed from its front or rear, the axis of rotation including a lateral offset from the main body rotational axis so that the axis of rotation of each carrier does not intersect with the main body rotational axis, the angle being such as to locate said excavation means at or near to the longitudinal axis at a location away from said main body in a direction of excavation when in use, said at least one carrier having a rotation direction opposite to the rotation direction of the main body when said rotation directions are viewed along the direction of the longitudinal axis when said excavation bit is in use.

2. The excavation bit as claimed in claim 1, wherein said at least one carrier receives motive power from the drill rod.

3. The excavation bit as claimed in claim 2, wherein rotation of said at least one carrier results in the rotation of said main body around the drill rod.

4. The excavation bit as claimed in claim 1, further comprising at least one motor, and wherein said at least one carrier receives motive power from said at least one motor.

5. The excavation bit as claimed in claim 1, further comprising a reaction member mounted to said main body to engage a wall of a bore formed by said excavation bit; and wherein said at least one carrier is only one carrier.

6. The excavation bit as claimed in claim 1, wherein said at least one carrier includes at least two carriers.

7. The excavation bit as claimed in claim 1, wherein the angle between the axis of rotation of said at least one carrier and the main body rotational axis when measured or viewed from the front or rear of said at least one carrier is in the range of greater than but not equal to 0° and less than but not equal to 90°, such that a level of thrust in an excavation direction and a magnitude of force to cause rotation of at least one of said excavation bit and said at least one carrier around the longitudinal axis, which will be appropriate for a type of material to be excavated.

8. The excavation bit as claimed in claim 1, wherein at least one of said at least one carrier and said excavation means approach but never cross the longitudinal axis.

9. The excavation bit as claimed in claim 1, wherein the lateral offset, when viewed from the axis of rotation of each said at least one carrier, is in the same direction as the direction of rotation of said main body when in use.

10. The excavation bit as claimed in claim 1, wherein the angular speeds of rotation of an excavation means in contact with earth to be excavated on said at least one carrier and said main body are substantially the same but in opposite directions when measured in a plane perpendicular to the longitudinal axis of the drill rod.

11. The excavation bit as claimed in claim 1, wherein said excavation means follows a substantially straight line path when said excavation means engages the ground to be excavated and when viewed along the direction of the longitudinal axis.

12. The excavation bit as claimed in claim 1, wherein said at least one carrier is of an annular construction.

13. The excavation bit as claimed in claim 1, wherein said main body includes a drive shaft, and said at least one carrier includes a gear; and said drive shaft engages, either directly or via an intermediate gear, said gear of said at least one carrier to thereby rotate said at least one carrier.

14. The excavation bit as claimed in claim 1, wherein said excavation means includes one of the following: a pick, a drag, a roller button, a roller tooth, a disc roller cutter, a blade, and a knife.

15. The excavation bit as claimed in claim 1, wherein said at least one carrier has as many excavation means mounted thereon to ensure that at any one time at least one excavation means of said at least one carrier is in engagement with the ground to be excavated.

16. The excavation bit as claimed in claim 1, further comprising a pilot bit rotatably mounted thereon.

17. The excavation bit as claimed in claim 1, wherein excavating means are located on surfaces of said at least one carrier adjacent or near to a maximum perpendicular distance from the axis of rotation.

18. The excavation bit as claimed in claim 1, wherein said excavation bit is constructed as a reamer and is adapted to be pulled through earth as excavation occurs.

19. The excavation bit as claimed in claim 1, further comprising a stabilizer affixed or rotatably attached to said main body, and wherein said stabilizer assists said excavation bit in keeping to a desired path.

20. The excavation bit as claimed in claim 1, further comprising at least one of a means for assisting removal of debris from the bore and a means for lubricating said excavation bit in use.

21. The excavation bit as claimed in claim 1, wherein said at least one carrier receives motive power from the drill rod rotating said main body.

22. The excavation bit as claimed in claim 21, wherein rotation of said main body by the drill rod results in the rotation of said at least one carrier about the axis of rotation of said at least one carrier.

23. An excavation bit for attatchment to a drill rod comprising:

a main body having a rotational axis which is coaxial with a longitudinal axis of the drill rod when connected to said excavation bit;

at least one carrier rotatably connected to said main body and having means for excavating positioned about its periphery, each carrier having an axis of rotation at an angle to the main body rotational axis when said carrier is viewed from its front or rear, the axis of rotation including a lateral offset from the main body rotational axis so that the axis of rotation of each carrier does not intersect with the main body rotational axis, the angle being such as to locate said excavation means at or near to the longitudinal axis at a location away from said main body in a direction of excavation when in use, said at least one carrier having a rotation direction opposite to the rotation direction of said main body when the rotation directions are viewed along the direction of the longitudinal axis when said excavation bit is in use;

whereby rotation of said main body by the drill rod results in the rotation of said at least one carrier about said at least one carrier axis of rotation.

* * * * *